US011317230B1

(12) United States Patent
Chen

(10) Patent No.: US 11,317,230 B1
(45) Date of Patent: Apr. 26, 2022

(54) LOUDSPEAKER HAVING DAMPER WITH WIRE FIXED BY SEWING THREAD

(71) Applicant: Vincent Chen, Taipei (TW)

(72) Inventor: Vincent Chen, Taipei (TW)

( * ) Notice: Subject to any disclaimer, the term of this patent is extended or adjusted under 35 U.S.C. 154(b) by 0 days.

(21) Appl. No.: 17/114,514

(22) Filed: Dec. 8, 2020

(51) Int. Cl.

| | |
|---|---|
| ***H04R 9/04*** | (2006.01) |
| ***H04R 31/00*** | (2006.01) |
| ***D03D 1/00*** | (2006.01) |
| ***H04R 9/06*** | (2006.01) |
| *H04R 9/02* | (2006.01) |

(52) U.S. Cl.
CPC ..... *H04R 31/006* (2013.01); *D03D 1/00* (2013.01); *H04R 9/043* (2013.01); *H04R 9/06* (2013.01); *H04R 9/025* (2013.01)

(58) Field of Classification Search
CPC ..... H04R 1/06; H04R 9/043; D03D 1/0088
See application file for complete search history.

(56) References Cited

U.S. PATENT DOCUMENTS

| | | | | |
|---|---|---|---|---|
| 7,082,667 | B2 * | 8/2006 | Auerbach | H04R 1/06 29/594 |
| 10,526,731 | B2 * | 1/2020 | Podhajny | D03D 1/0088 |
| 10,827,611 | B2 * | 11/2020 | Sugita | H05K 1/18 |
| 2007/0283677 | A1 * | 12/2007 | Ohara | H04R 9/043 57/210 |
| 2007/0287344 | A1 * | 12/2007 | Ohara | H04R 9/043 442/2 |
| 2011/0188699 | A1 * | 8/2011 | Shibaoka | D03D 15/593 381/428 |
| 2018/0260052 | A1 * | 9/2018 | Karagozler | D03D 1/0088 |
| 2018/0364804 | A1 * | 12/2018 | Hoen | G01L 1/146 |
| 2020/0087823 | A1 * | 3/2020 | Coxeter | D03D 11/02 |
| 2020/0125195 | A1 * | 4/2020 | Tremmel | D05C 17/00 |
| 2021/0087719 | A1 * | 3/2021 | Grena | B32B 5/026 |

* cited by examiner

*Primary Examiner* — Ryan Robinson
(74) *Attorney, Agent, or Firm* — Lin & Associates Intellectual Property, Inc.

(57) ABSTRACT

A loudspeaker includes a loudspeaker body, a voice coil and a damper. The damper includes a main body, a wire and a first fixing sewing thread. The first fixing sewing thread includes a first sewing part including first to fourth wire winding portions and first to third yarn winding portions. The first and third wire winding portions extend from one side of the wire through upside of the wire to the other side of the wire while the second and fourth wire winding portions extend in the opposite direction The first to third yarn winding portions connect adjacent two wire winding portions and pass under one of the weft yarns, respectively.

12 Claims, 18 Drawing Sheets

LOUDSPEAKER HAVING DAMPER WITH WIRE FIXED BY SEWING THREAD

BACKGROUND OF THE INVENTION

1. Field of the Invention

The present invention relates to a loudspeaker, and more particularly, to a loudspeaker having a damper with a wire fixed by a sewing thread.

2. The Prior Arts

In the general moving coil loudspeaker, the principle that the reaction force of a fixed magnetic field causes another magnetic field to move in the opposite direction (i.e., opposite magnetisms attract each other, and like magnetisms repels each other) is used to produce sound. Further, the power alternating current generated by the power amplifier is transmitted to the voice coil through a wire to change the polarity of the magnetic field, such that the voice coil generates a reaction force against the fixed magnetic region generated by the magnetic circuit device. The forward pulse causes the diaphragm move outward relative to the magnet, while the backward pulse causes the diaphragm move inward. When the voice coil pushes the diaphragm to reciprocate, the diaphragm pushes air, and the air pressure changes to form sound waves. The damper is responsible for maintaining the correct position of the voice coil in the gap of the magnet core, ensuring that the voice coil reciprocates along the axis direction when being forced.

However, in the conventional loudspeaker, the wire is suspended in the air without any support, so that the wire alone bears the vibration force transmitted from the voice coil. Thereby, after the voice coil moves rapidly and frequently for a period of time, the wire is easy to fatigue and be broken.

SUMMARY OF THE INVENTION

The main objective of the present invention is to provide a loudspeaker having a damper with a wire fixed by a sewing thread, wherein the wire is fixed on the main body by the sewing thread, such that the main body can support the wire, and the main body as well as the wire together bear the vibration transmitted from the voice coil, thereby the wire has an improved fatigue resistance and is not easy to be broken.

In order to achieve the above objectives, the present invention provides a loudspeaker having damper with wire fixed by sewing thread, including a loudspeaker body, a voice coil and a damper.

The voice coil is movably disposed in the loudspeaker body.

The damper includes a main body, at least one wire, and at least one first fixing sewing thread.

The main body is formed by interweaving a plurality of warp yarns and a plurality of weft yarns, and a solid resin layer is formed on a surface of the main body. The main body includes a plurality of wave structures, a center hole and at least one wire disposing area. The wave structures are sequentially arranged from an outer edge of the main body to the center hole. The center hole is sleeved at the voice coil. The at least one wire disposing area extends radially from the outer edge of the main body through the wave structures to the center hole.

The at least one wire is disposed on the at least one wire disposing area, and one end of the at least one wire is connected to the voice coil.

The at least one first fixing sewing thread includes a plurality of first sewing parts, the first sewing parts are arranged at intervals along an extending direction of the at least one wire and fix the at least one wire on the at least one wire disposing area. Wherein, each of the first sewing parts includes a first wire winding portion, a first yarn winding portion, a second wire winding portion, a second yarn winding portion, a third wire winding portion, a third yarn winding portion and a fourth wire winding portion. The first wire winding portion of each of the first sewing parts extends from a first side of the at least one wire through upside of the at least one wire, at least one of the warp yarns and at least one of the weft yarns to a second side of the at least one wire. The first yarn winding portion of each of the first sewing parts connects the first wire winding portion of each of the first sewing parts and the second wire winding portion of each of the first sewing parts, and passes under one of the weft yarns. The second wire winding portion of each of the first sewing parts extends from the second side of the at least one wire through upside of the at least one wire, at least one of the warp yarns and at least one of the weft yarns to the first side of the at least one wire. The second yarn winding portion of each of the first sewing parts connects the second wire winding portion of each of the first sewing parts and the third wire winding portion of each of the first sewing parts, and passes under one of the weft yarns. The third wire winding portion of each of the first sewing parts extends from the first side of the at least one wire through upside of the at least one wire, at least one of the warp yarns and at least one of the weft yarns to the second side of the at least one wire. The third yarn winding portion of each of the first sewing parts connects the third wire winding portion of each of the first sewing parts and the fourth wire winding portion of each of the first sewing parts, and passes under one of the weft yarns. The fourth wire winding portion of each of the first sewing parts extends from the second side of the at least one wire through upside of the at least one wire, at least one of the warp yarns and at least one of the weft yarns to the first side of the at least one wire.

The present invention is advantageous in that the at least one wire can be fixed on the at least one wire disposing area by the at least one first fixing sewing thread, such that the main body can support the at least one wire, and the main body as well as the at least one wire together bear the vibration transmitted from the voice coil, thereby the at least one wire has an improved fatigue resistance and is not easy to be broken.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Herein after, a more detailed description of the implementation of the present invention with reference to the drawings and reference symbols, such that those skilled in the art can implement it after studying this written description.

Referring to FIGS. 1 to 6, the present invention provides a loudspeaker having a damper 30 with a wire 32 fixed by a sewing thread, including a loudspeaker body 10, a voice coil 20 and a damper 30.

Figure 1:
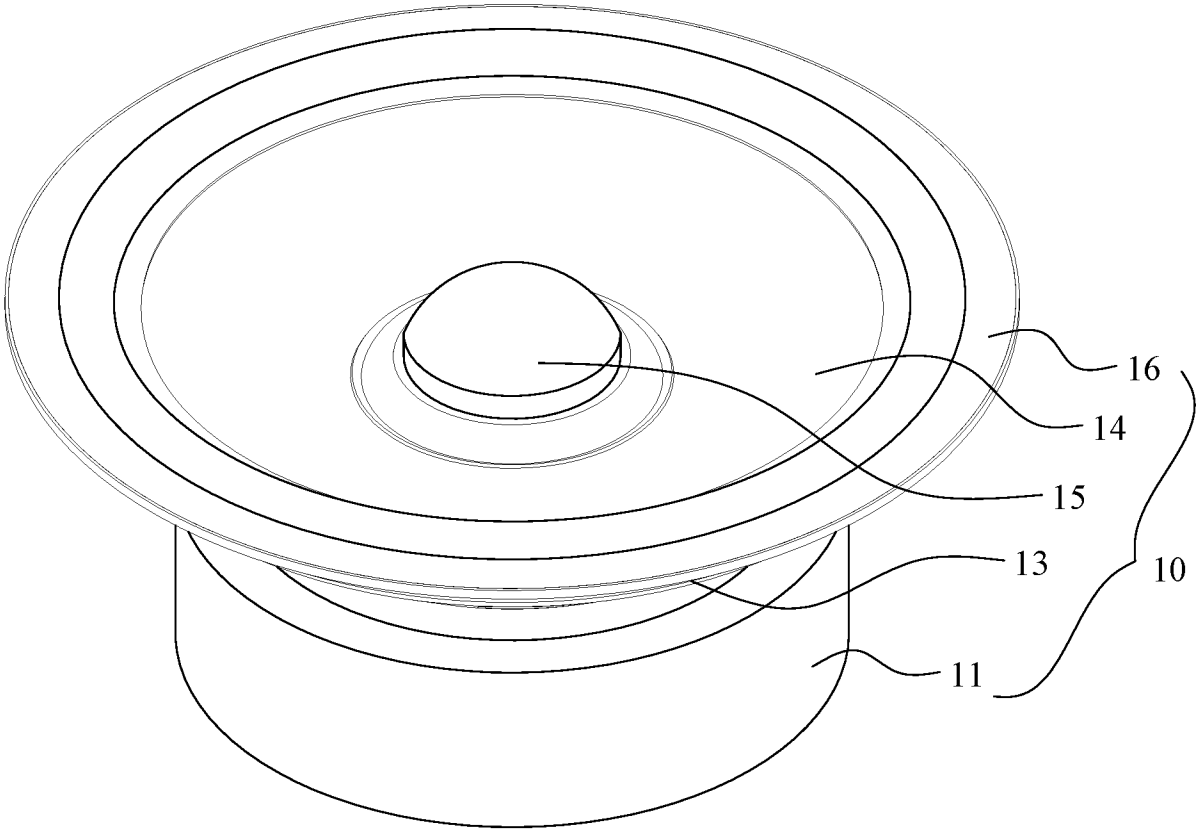
FIG. 1 is a perspective view of the loudspeaker of the present invention.
Figure 2:
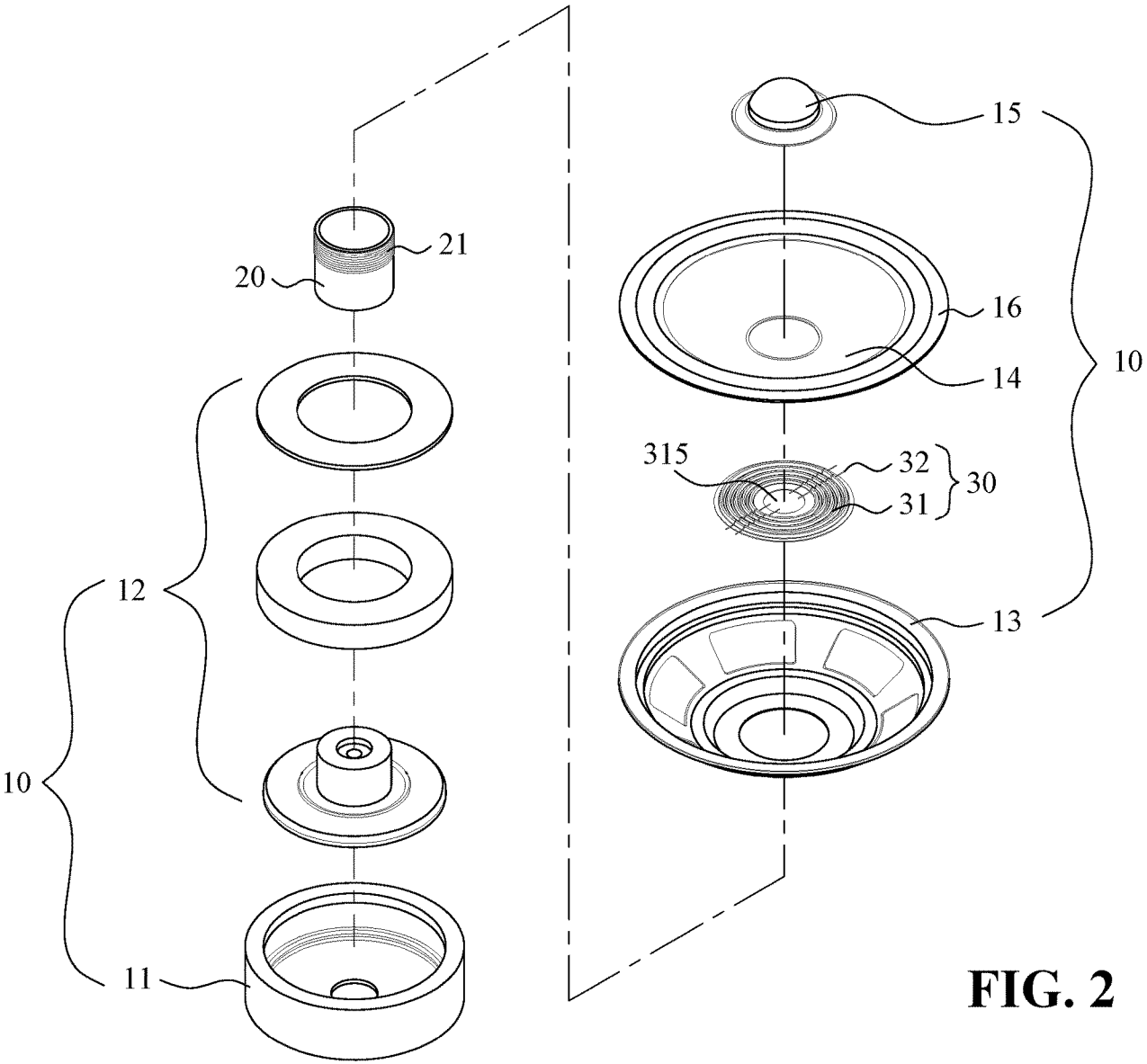
FIG. 2 is an exploded view of the loudspeaker of the present invention.
Figure 3:
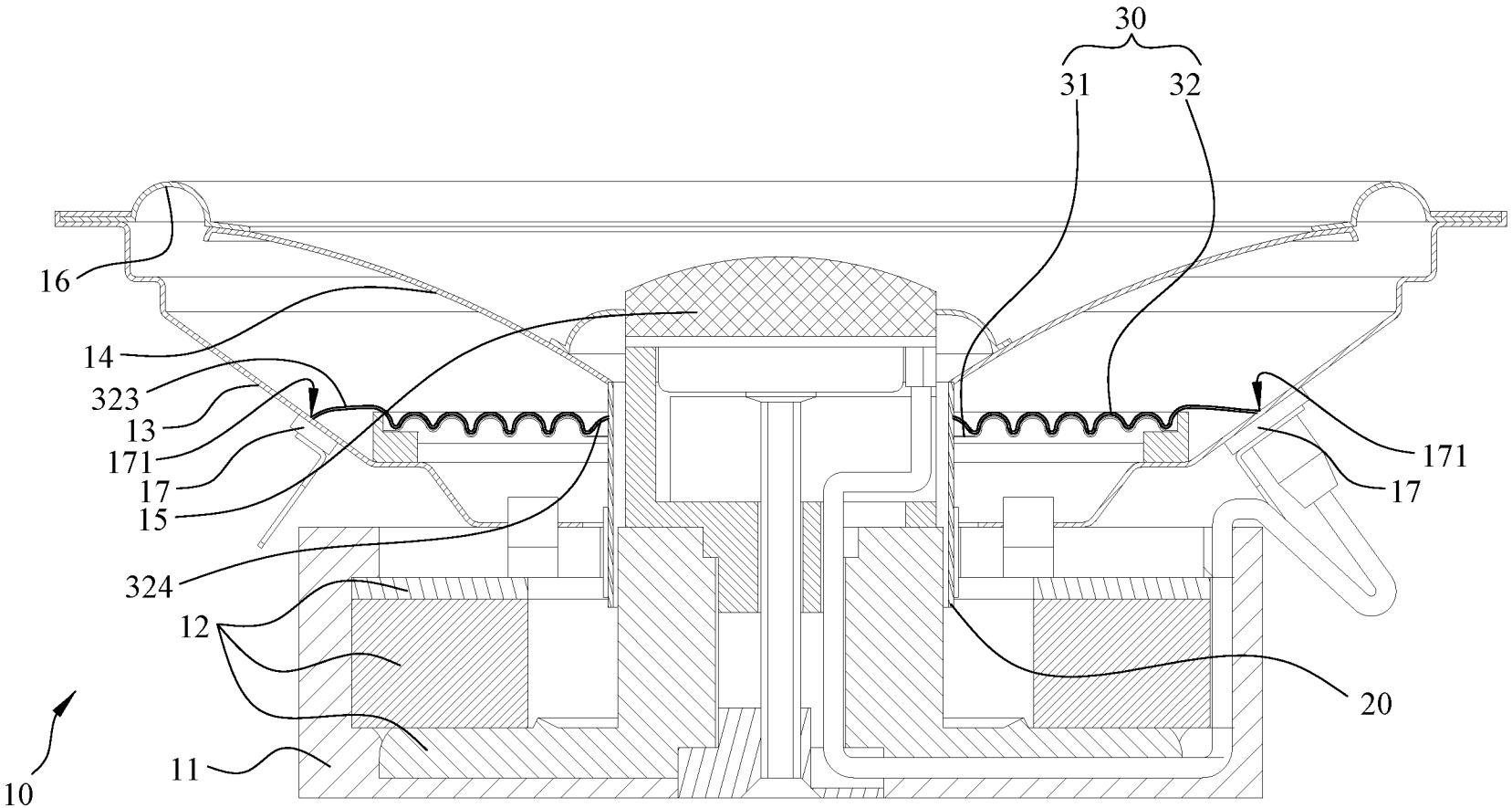
FIG. 3 is a cross-sectional view of the loudspeaker of the present invention.

As shown in FIGS. 1, 2 and 3, the loudspeaker body 10 includes a base 11, a magnetic circuit device 12, an outer frame 13, a diaphragm 14, a dust cover 15, a surround 16 and at least one connecting terminal 17. The magnetic circuit device 12 is disposed on the base 11. A voice coil 20 is movably disposed in the magnetic circuit device 12 and has a coil 21. The outer frame 13 is disposed at upper side of the magnetic circuit device 12. The diaphragm 14 is sleeved at the voice coil 20. The dust cover 15 is disposed at a center hole of the diaphragm 14. The surround 16 is disposed between the top edge of the diaphragm 14 and the outer frame 13. The at least one connecting terminal 17 is disposed on the outer frame 13 and has a contact point 171. The internal structure configuration of the loudspeaker body 10 is not limited to this.

As shown in FIGS. 4 to 7, the damper 30 includes a main body 31, at least one wire 32, and at least one first fixing sewing thread 33.

The main body 31 is formed by interweaving a plurality of warp yarns 311 and a plurality of weft yarns 312, and a solid resin layer 313 is formed on the surface of the main body 31. The outer frame 13 supports the outer edge of the main body 31. The main body 31 includes a plurality of wave structures 314, a center hole 315, and at least one wire disposing area 316, and the wave structures 314 are sequentially arranged from the outer edge of the main body 31 to the center hole 315. The center hole 315 is sleeved at the voice coil 20, and the at least one wire disposing area 316 extends radially from the outer edge of the main body 31 through the wave structures 314 to the center hole 315. Each wave structure 314 includes a wave crest 3141, a wave trough 3142, an inner sidewall 3143, and an outer sidewall 3144.

The least one wire 32 is disposed on the at least one wire disposing area 316 and has a first end 323 and a second end 324. As shown in FIG. 3, the first end 323 of the at least one wire 32 is connected to the contact point 171 of the at least one connecting terminal 17, and the second end 324 of the at least one wire 32 is connected to the coil 21 of the voice coil 20. Preferably, the cross section of the at least one wire 32 is circular. In other embodiments, the cross section of the at least one wire 32 may also be a flat section (not shown).

The at least one first fixing sewing thread 33 includes a plurality of first sewing parts 331. The first sewing parts 331 are arranged at intervals along the extending direction of the at least one wire 32, and fix the at least one wire 32 on the at least one wire disposing area 316. Each first sewing part 331 includes a first wire winding portion 332, a first yarn winding portion 333, a second wire winding portion 334, a second yarn winding portion 335, a third wire winding portion 336, a third yarn winding portion 337, and a fourth wire winding portion 338. The first wire winding portion 332 extends from a first side 321 of the at least one wire 32 through upside of the at least one wire 32, at least one of the warp yarns 311 and at least one of the weft yarns 312 to a second side 322 of the at least one wire 32. The first yarn winding portion 333 connects the first wire winding portion 332 and the second wire winding portion 334, and passes under one of the weft yarns 312. The second wire winding portion 334 extends from the second side 322 of the at least one wire 32 through upside of the at least one wire 32, at least one of the warp yarns 311 and at least one of the weft yarns 312 to the first side 321 of the at least one wire 32. The second yarn winding portion 335 connects the second wire winding portion 334 and the third wire winding portion 336, and passes under one of the weft yarns 312. The third wire winding portion 336 extends from the first side 321 of the at least one wire 32 through upside of the at least one wire 32, at least one of the warp yarns 311 and at least one of the weft yarns 312 to the second side 322 of the at least one wire 32. The third yarn winding portion 337 connects the third wire winding portion 336 and the fourth wire winding portion 338, and passes under one of the weft yarns 312. The fourth wire winding portion 338 extends from the second side 322 of the at least one wire 32 through upside of the at least one wire 32, at least one of the warp yarns 311 and at least one of the weft yarns 312 to the first side 321 of the at least one wire 32. As a result, the at least one wire 32 can be fixed on the at least one wire disposing area 316 by the at least one first fixing sewing thread 33, such that the main body 31 can support the at least one wire 32, and the main body 31 as well as the at least one wire 32 together bear the vibration transmitted from the voice coil 20, thereby the at least one wire 32 has an improved fatigue resistance and is not easy to be broken.

Figure 5:
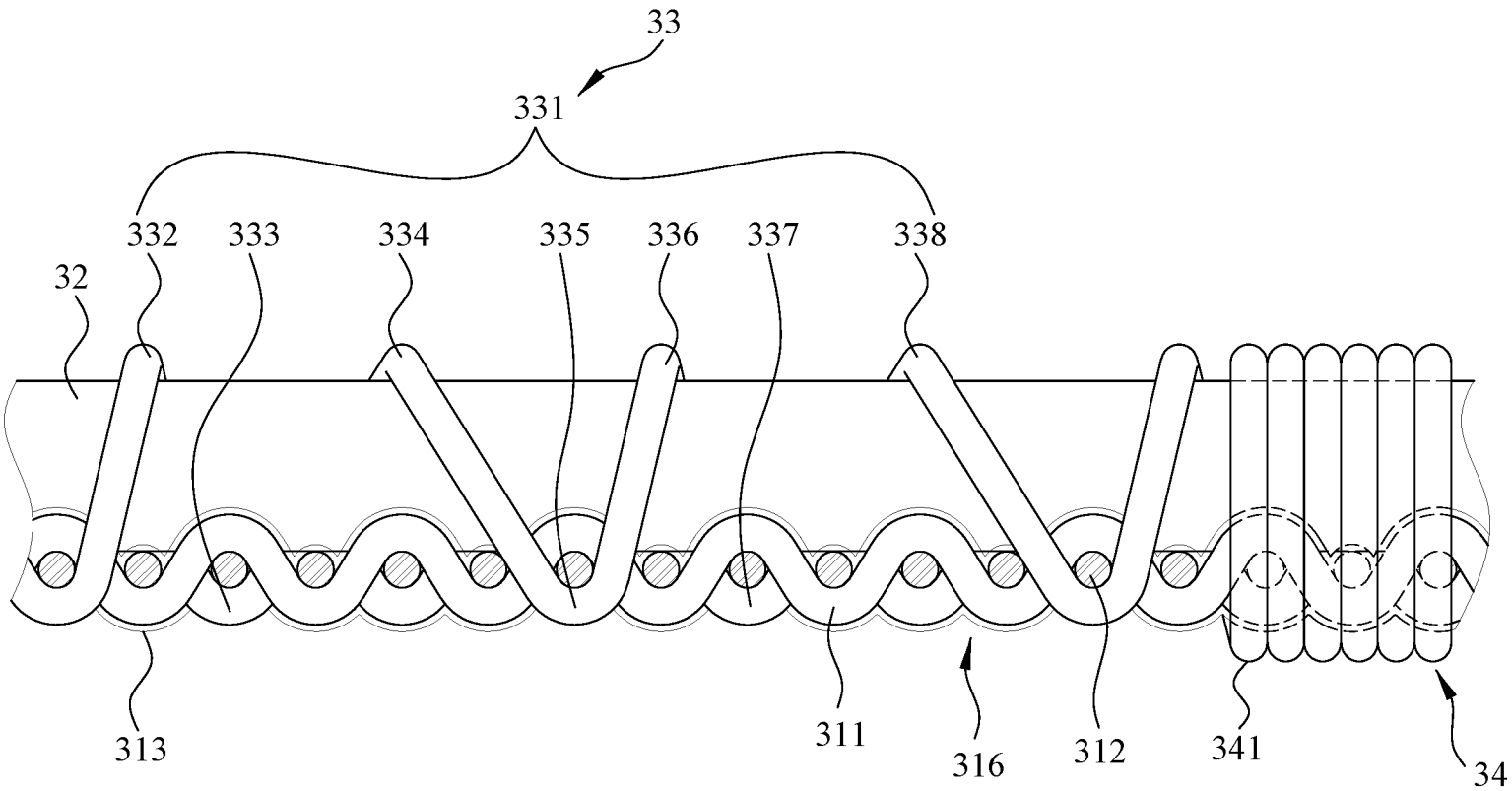
FIG. 5 is a cross-sectional view along line A-A of FIG. 4.

As shown in FIG. 5, in the first embodiment, the numbers of the warp yarns 311 passed by the first wire winding portions 332 are the same, and the numbers of the weft yarns 312 passed by the first wire winding portions 332 are the same; The numbers of the warp yarns 311 passed by the second wire winding portions 334 are the same, and the numbers of the weft yarns 312 passed by the second wire winding portions 334 are the same; The numbers of the warp yarns 311 passed by the third wire winding portions 336 are the same, and the numbers of the weft yarns 312 passed by the third wire winding portions 336 are the same; the numbers of the warp yarns 311 passed by the fourth wire winding portions 338 are the same, and the numbers of the weft yarns 312 passed by the fourth wire winding portions 338 are the same. Thereby, the at least one wire 32 is fixed on the at least one wire disposing area 316 by the at least one first fixing sewing thread 33 in a quite regular winding manner.

Furthermore, the method for manufacturing the damper 30 includes preparation, impregnating, drying, wire disposing, forming and cutting steps. In the preparation step, a base material is prepared. In the impregnating step, the base material is impregnated in a resin solution. In the drying step, the base material is dried to form a solid resin layer 313 on the base material. In the wire disposing step, at least one wire 32 is disposed on the base material. In the forming step, a damper 30 is formed on the base material by thermoforming. In the cutting step, the damper 30 is cut from the base material.

Figure 6:
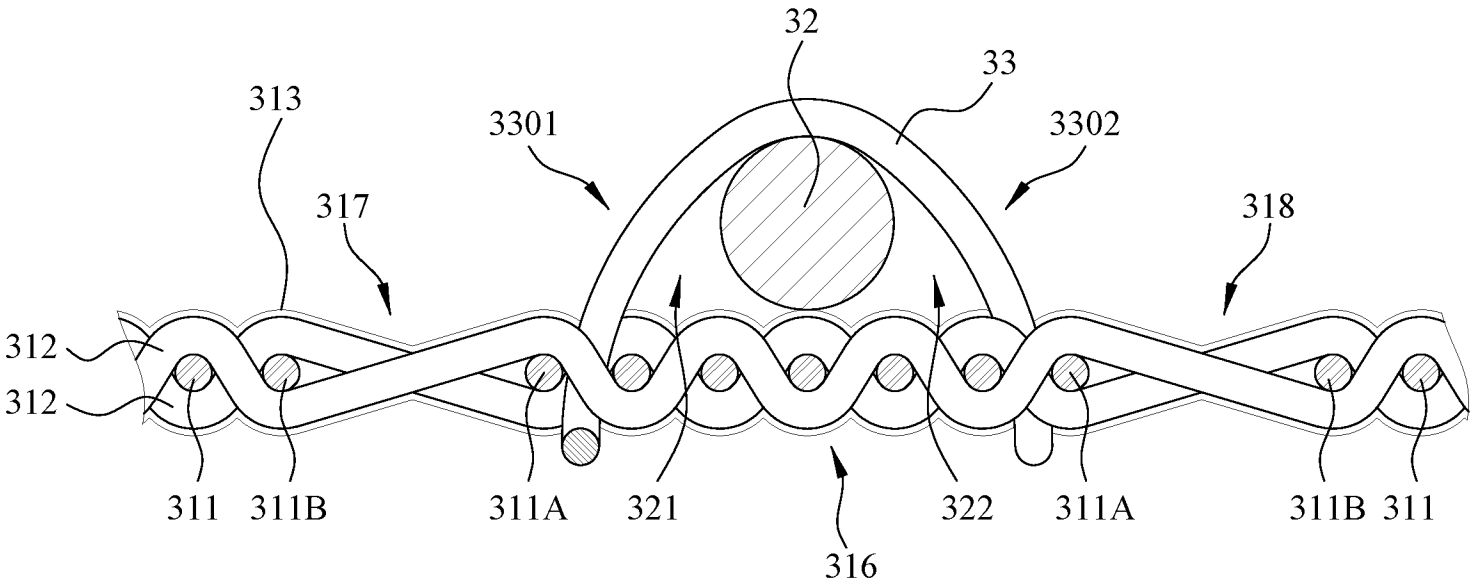
FIG. 6 is a cross-sectional view along line B-B of FIG. 4.

Since the base material contains resin and thus is rich in elasticity, when the damper 30 is formed on the base material by thermoforming, the damper 30 is shrunk from a flat shape to a wave shape as a result of thermoforming. As shown in FIG. 6, the wire 32 is harder than the main body 31, the elasticity and toughness of the wire 32 are worse than those of the main body 31, and the at least one wire 32 is fixed on the wire disposing area 316 by the at least one first fixing sewing thread 33 in a quite regular winding manner. Therefore, affected by the shrinkage, a first elastic adjustment area 317 is formed between two warp yarns 311 (i.e., a first warp yarn 311A and a second warp yarn 311B) closest to outside of a first side 3301 of the at least one first fixing sewing thread 33, and a second elastic adjustment area 318 is formed between two warp yarns 311 (i.e., a first warp yarn 311A and a second warp yarn 311B) closest to outside of a second side 3302 of the at least one first fixing sewing thread 33. The widths of the first elastic adjustment area 317 and the second elastic adjustment area 318 are equal to each other, and the distances between the remaining warp yarns 311 are less than the width of each of the first elastic adjustment area 317 and the second elastic adjustment area 318. By the first elastic adjustment area 317 and the second elastic adjustment area 318, the hardness, elasticity and toughness of the at least one wire disposing area 316 can be adjusted. Therefore, the at least one wire disposing area 316 becomes softer, and its elasticity and toughness are increased. Thereby, the hardness, elasticity, and toughness of the combination of the at least one wire disposing area 316 and the at least one wire 32 are equivalent to those of other areas of the main body 31. As a result, the damper 30 has uniform hardness, elasticity and toughness, thereby having uniform elastic resilience and fatigue resistance, and being not easy to be deformed and brittle, which improves the output sound quality of the loudspeaker.

Figure 4:
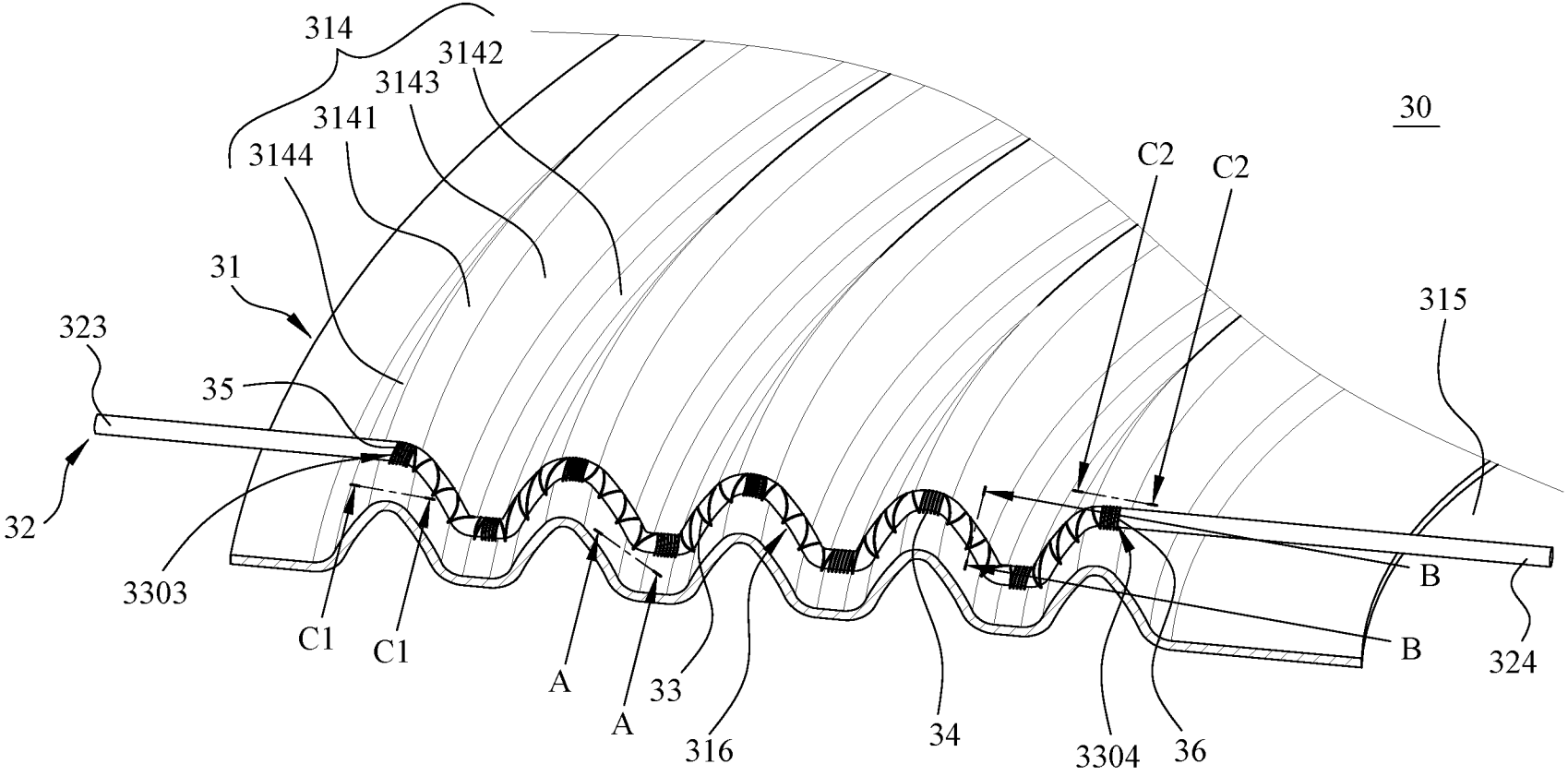
FIG. 4 is a schematic view of the damper of the first embodiment of the present invention.

As shown in FIGS. 4 and 5, in the first embodiment, one end of the at least one first fixing sewing thread 33 close to the outer edge of the main body 31 is defined as a first end 3303, and one end of the at least one first fixing sewing thread 33 close to the inner edge of the main body 31 is defined as a second end 3304. The at least one first fixing sewing thread 33 further includes at least one first intermediate sewing structure 34. The at least one first intermediate sewing structure 34 is disposed between the first end 3303 and the second end 3304 of the at least one first fixing sewing thread 33, extends from the first side 321 of the at least one wire 32 through upside of the at least one wire 32 to the second side 322 of the at least one wire 32, and is fixed at a part of the plurality of warp yarns 311 and a part of the plurality of weft yarns 312 around the at least one wire disposing area 316. In other words, the at least one first intermediate sewing structure 34 can be distributed at any one of the wave crests 3141, the wave troughs 3142, the inner sidewalls 3143 and the outer sidewalls 3144 of the wave structures 314. Therefore, the at least one first intermediate sewing structure 34 can further improve the effect of fixing the at least one wire 32 on the at least one wire disposing area 316.

Preferably, as shown in FIG. 4, the at least one first fixing sewing thread 33 includes a plurality of first intermediate sewing structures 34 arranged at intervals between the first end 3303 and the second end 3304 of the at least one first fixing sewing thread 33. When the number of the first intermediate sewing structures 34 is larger, the effect of fixing the at least one wire 32 on the at least one wire disposing area 316 is better.

Preferably, as shown in FIG. 5, each first intermediate sewing structure 34 includes a plurality of winding sewing threads 341 arranged sequentially along the extending direction of the at least one wire 32 and being close to each other. The radial width of each first intermediate sewing structure 34 is fixed, while the number of lines of the winding sewing threads 341 will affect the axial length of each first intermediate sewing structures 34. Wherein, the axial length and the radial width of each first intermediate sewing structures 34 are equal to each other, which enables each first intermediate sewing structure 34 to fix the at least one wire 32 on the at least one wire disposing area 316 in a stronger manner.

Figure 7:
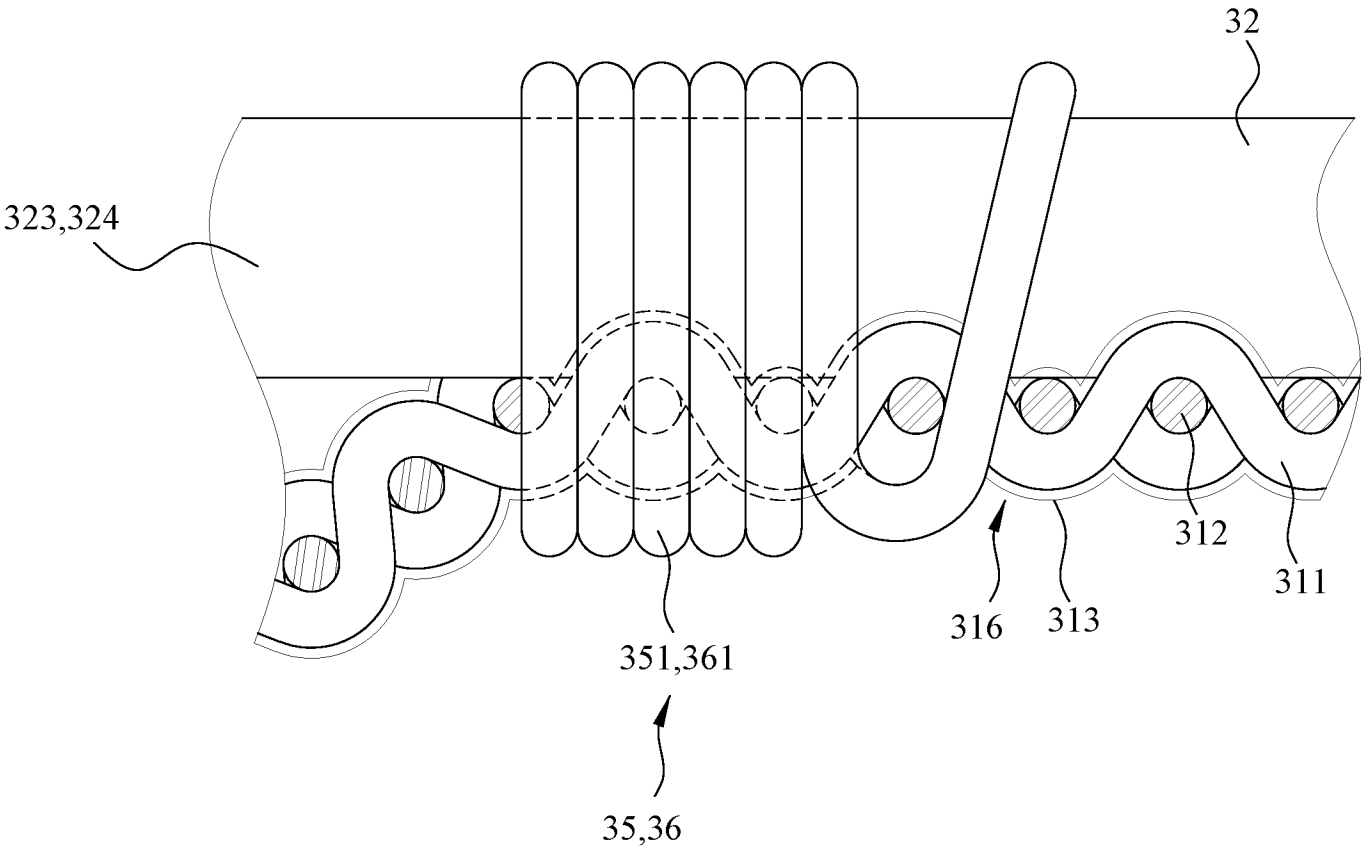
FIG. 7 is a cross-sectional view along line C1-C1 and line C2-C2 of FIG. 4.

As shown in FIGS. 4 and 7, in the first embodiment, the first end 3303 of the at least one first fixing sewing thread 33 further forms a first end sewing structure 35, and the second end 3304 of the at least one first fixing sewing thread 33 further forms a second end sewing structure 36. The first end sewing structure 35 of the at least one first fixing sewing thread 33 extends from the first side 321 of the at least one wire 32 through upside of the at least one wire 32 to the second side 322 of the at least one wire 32, and is fixed at a part of the plurality of warp yarns 311 and a part of the plurality of weft yarns 312 around the at least one wire disposing area 316. The second end sewing structure 36 of the at least one first fixing sewing thread 33 extends from the first side 321 of the at least one wire 32 through upside of the at least one wire 32 to the second side 322 of the at least one wire 32, and is fixed at a part of the plurality of warp yarns 311 and a part of the plurality of weft yarns 312 around the at least one wire disposing area 316. As a result, the first end sewing structure 35 and the second end sewing structure 36 of the at least one first fixing sewing thread 33 can be fixed at the at least one wire disposing area 316, thereby preventing the first end 3303 and the second end 3304 of the at least one first fixing sewing thread 33 from lifting upward relative to the main body 31, and preventing the at least one first fixing sewing thread 33 from being pulled off the main body 31 at the first end 3303 or the second end 3304 of the at least one first fixing sewing thread 33. In addition, the first end sewing structure 35 and the second end sewing structure 36 of the at least one first fixing sewing thread 33 can further improve the effect of fixing the at least one wire 32 on the at least one wire disposing area 316.

Preferably, the first end sewing structure 35 of the at least one first fixing sewing thread 33 includes a plurality of winding sewing threads 351 arranged sequentially along the extending direction of the at least one wire 32 and being close to each other. The second end sewing structure 36 of the at least one first fixing sewing thread 33 includes a plurality of winding sewing threads 361 arranged sequentially along the extending direction of the at least one wire 32 and being close to each other. The radial widths of the first end sewing structure 35 and the second end sewing structure 36 of the at least one first fixing sewing thread 33 are fixed, while the number of lines of the winding sewing threads 351 will affect the axial length of the first end sewing structure 35 of the at least one first fixing sewing thread 33, and the number of lines the winding sewing threads 361 will affect the axial length of the second end sewing structure 36 of the at least one first fixing sewing thread 33. Wherein, the axial length and the radial width of the first end sewing structure 35 of the at least one first fixing sewing thread 33 are equal to each other, and the axial length and the radial width of the second end sewing structure 36 of the at least one first fixing sewing thread 33 are equal to each other. In other words, the first end sewing structure 35 and the second end sewing structure 36 of the at least one first fixing sewing thread 33 are in rectangular block shapes. Thereby, the first end sewing structure 35 and the second end sewing structure 36 of the at least one first fixing sewing thread 33, which are in rectangular block shapes, can fix the at least one wire 32 on the at least one wire disposing area 316 in a stronger manner.

As shown in FIG. 3, in the first embodiment, the height of the contact point 171 of the connecting terminal 17 is equal to that of each wave crest 3141, and the height of the coil 21 of the voice coil 20 is equal to that of each wave crest 3141. Therefore, as shown in FIGS. 3 and 4, the first end sewing structure 35 of the at least one first fixing sewing thread 33 is located at the wave crest 3141 of the wave structure 314 closest to the outer edge of the main body 31, so as to limit the first end 323 of the at least one wire 32 to extend in a direction parallel to the main body 31. Also, the second end sewing structure 36 of the at least one first fixing sewing thread 33 is located at the wave crest 3141 of the wave structure 314 closest to the inner edge of the main body 31, so as to limit the second end 324 of the at least one wire 32 to extend in a direction parallel to the main body 31. Thereby, the first end 323 of the at least one wire 32 can extend, at a shortest distance, horizontally to the contact point 171 of the connecting terminal 17 and be firmly connected to the contact point 171 of the connecting terminal 17, and the second end 324 of the at least one wire 32 can extend, at a shortest distance, horizontally to the coil 21 of the voice coil 20 and be firmly connected to the coil 21 of the voice coil 20.

Figure 8:
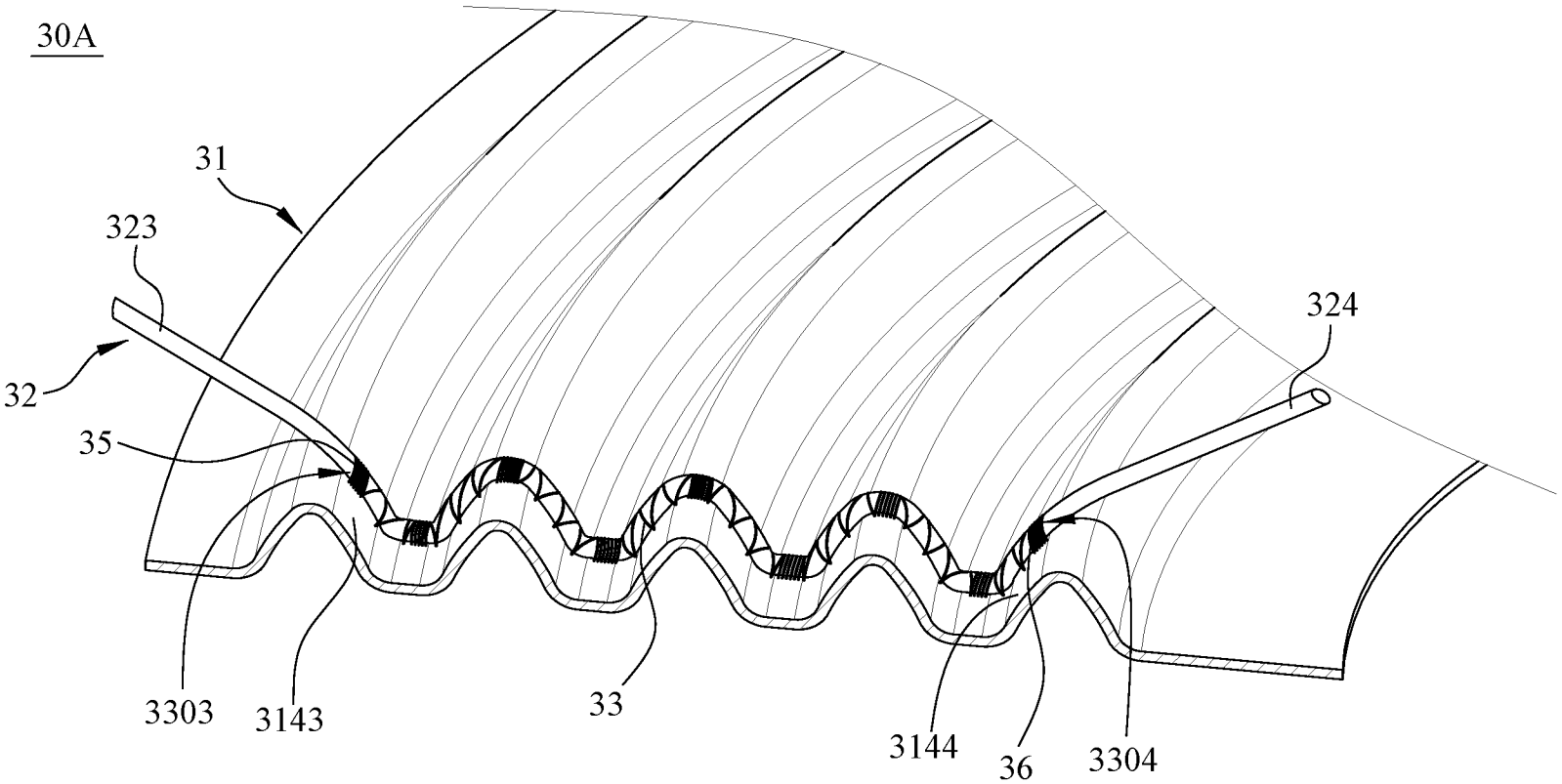
FIG. 8 is a schematic view of the damper of the second embodiment of the present invention.

Referring to FIG. 8, a damper 30A of the second embodiment is different from the damper 30 of the first embodiment in that the height of the contact point 171 of the connecting terminal 17 is higher than that of each wave crest 3141, and the height of the coil 21 of the voice coil 20 is higher than that of each wave crest 3141. Therefore, as shown in FIG. 8, the first end sewing structure 35 of the at least one first fixing sewing thread 33 is located at the inner sidewall 3143 of the wave structure 314 closest to the outer edge of the main body 31, so as to limit the first end 323 of the at least one wire 32 to extend in a direction tilting upward and outward relative to the main body 31. Also, the second end sewing structure 36 of the at least one first fixing sewing thread 33 is located at the outer sidewall 3144 of the wave structure 314 closest to the inner edge of the main body 31, so as to limit the second end 324 of the at least one wire 32 to extend in a direction tilting upward and inward relative to the main body 31. Thereby, the first end 323 of the at least one wire 32 can extend, at a shortest distance, upward and outward relative to the main body 31 to the contact point 171 of the connecting terminal 17 and be firmly connected to the contact point 171 of the connecting terminal 17, and the second end 324 of the at least one wire 32 can extend, at a shortest distance, upward and inward relative to the main body 31 to the coil 21 of the voice coil 20 and be firmly connected to the coil 21 of the voice coil 20.

Figure 9:
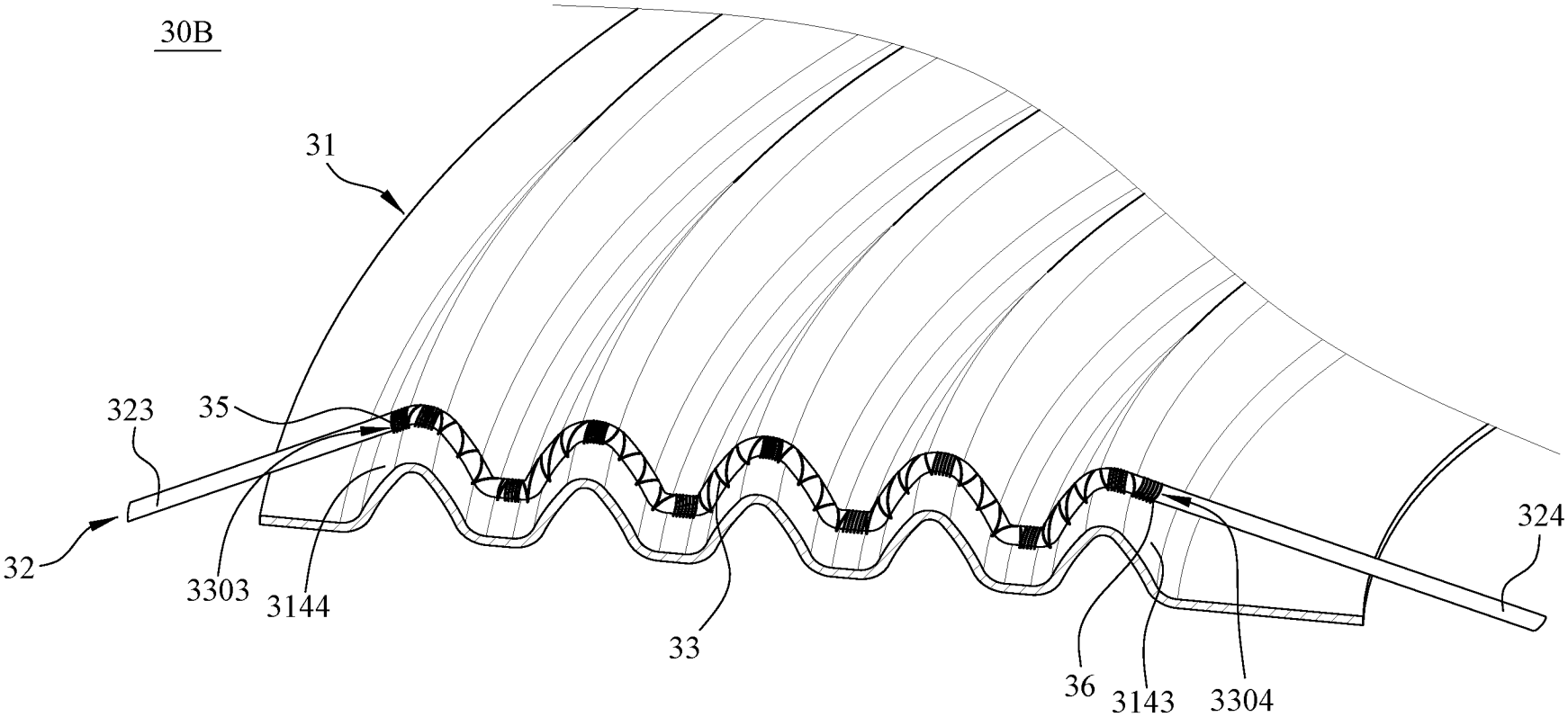
FIG. 9 is a schematic view of the damper of the third embodiment of the present invention.

Referring to FIG. 9, a damper 30B of the third embodiment is different from the damper 30 of the first embodiment in that the height of the contact point 171 of the connecting terminal 17 is lower than that of each wave crest 3141, and the height of the coil 21 of the voice coil 20 is lower than that of each wave crest 3141. Therefore, as shown in FIG. 9, the first end sewing structure 35 of the at least one first fixing sewing thread 33 is located at the outer sidewall 3144 of the wave structure 314 closest to the outer edge of the main body 31, so as to limit the first end 323 of the at least one wire 32 to extend in a direction tilting downward and outward relative to the main body 31. Also, the second end sewing structure 36 of the at least one first fixing sewing thread 33 is located at the inner sidewall 3143 of the wave structure 314 closest to the inner edge of the main body 31, so as to limit the second end 324 of the at least one wire 32 to extend in a direction tilting downward and inward relative to the main body 31. Thereby, the first end 323 of the at least one wire 32 can extend, at a shortest distance, downward and outward relative to the main body 31 to the contact point 171 of the connecting terminal 17 and be firmly connected to the contact point 171 of the connecting terminal 17, and the second end 324 of the at least one wire 32 can extend, at a shortest distance, downward and inward relative to the main body 31 to the coil 21 of the voice coil 20 and be firmly connected to the coil 21 of the voice coil 20.

Referring to FIGS. 10 to 13, a damper 30C of the fourth embodiment is different from the damper 30 of the first embodiment in that the damper 30C further includes at least one second fixing sewing thread 37. More specifically, the at least one second fixing sewing thread 37 includes a plurality of second sewing parts 371. The second sewing parts 371 are arranged at intervals along the extending direction of the at least one wire 32, and fix the at least one wire 32 on the at least one wire disposing area 316. Each second sewing part 371 includes a first wire winding portion 372, a first yarn winding portion 373, a second wire winding portion 374, a second yarn winding portion 375, a third wire winding portion 376, a third yarn winding portion 377, and a fourth wire winding portion 378. The first wire winding portion 372 extends from the second side 322 of the at least one wire 32 through upside of the at least one wire 32, the first wire winding portion 332, at least one of the warp yarns 311 and at least one of the weft yarns 312 to the first side 321 of the at least one wire 32. The first yarn winding portion 373 connects the first wire winding portion 372 and the second wire winding portion 374, and passes under one of the weft yarns 312. The second wire winding portion 374 extends from the first side 321 of the at least one wire 32 through upside of the at least one wire 32, the second wire winding portion 334, at least one of the warp yarns 311 and at least one of the weft yarns 312 to the second side 322 of the at least one wire 32. The second yarn winding portion 375 connects the second wire winding portion 374 and the third wire winding portion 376, and passes under one of the weft yarns 312. The third wire winding portion 376 extends from the second side 322 of the at least one wire 32 through upside of the at least one wire 32, the third wire winding portion 336, at least one of the warp yarns 311 and at least one of the weft yarns 312 to the first side 321 of the at least one wire 32. The third yarn winding portion 377 connects the third wire winding portion 376 and the fourth wire winding portion 378, and passes under one of the weft yarns 312. The fourth wire winding portion 378 extends from the first side 321 of the at least one wire 32 through upside of the at least one wire 32, the fourth wire winding portion 338, at least one of the warp yarns 311 and at least one of the weft yarns 312 to the second side 322 of the at least one wire 32. Thereby, the at least one wire 32 can be fixed more strongly on the at least one wire disposing area 316 by two fixing sewing threads such as the at least one first fixing sewing thread 33 and the at least one second fixing sewing thread 37, such that the main body 31 can support the at least one wire 32, and the main body 31 as well as the at least one wire 32 together bear the vibration transmitted from the voice coil 20, thereby the at least one wire 32 has an improved fatigue resistance and is not easy to be broken.

Figure 11:
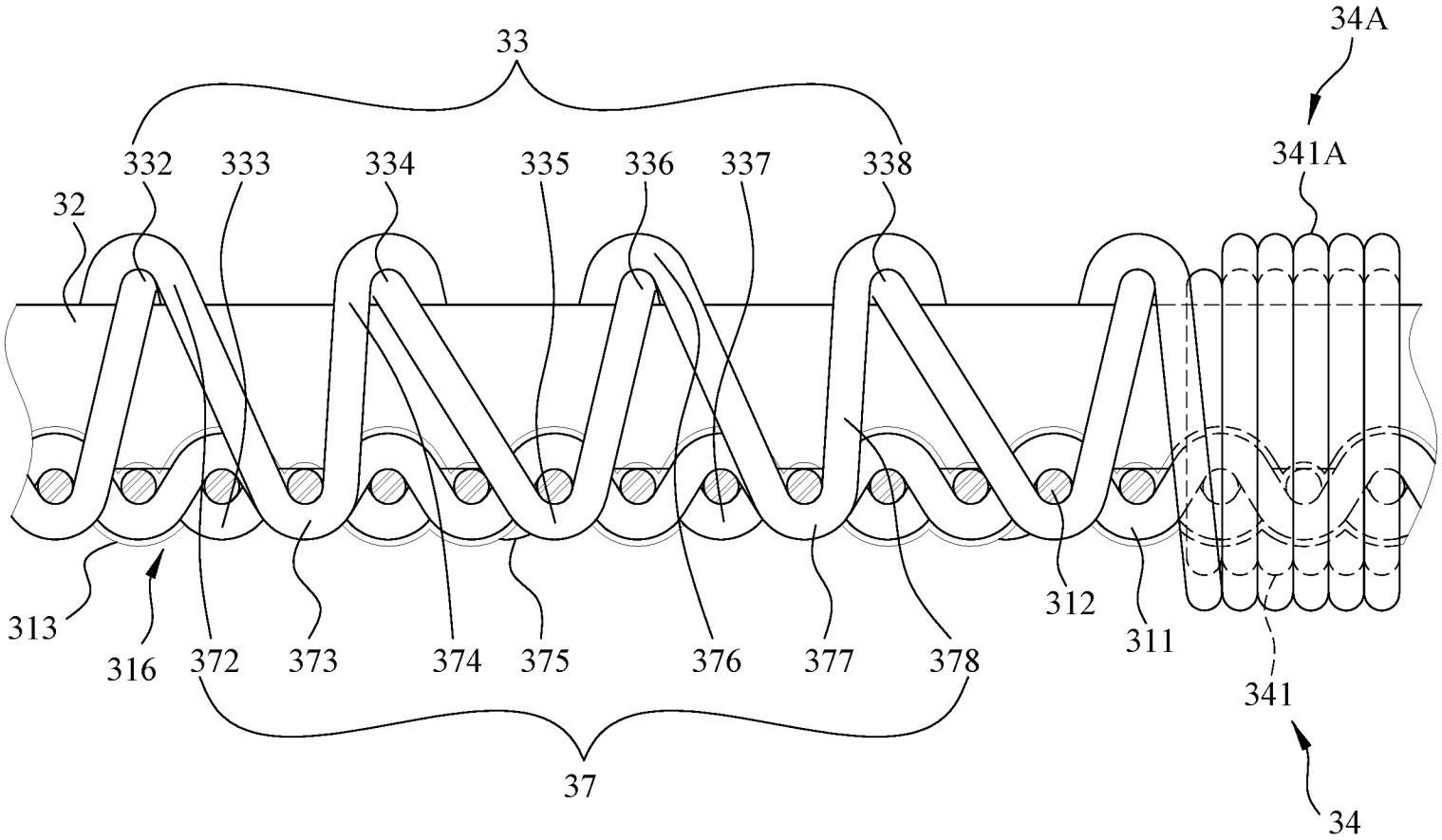
FIG. 11 is a cross-sectional view along line D-D of FIG. 10.

As shown in FIG. 11, in the fourth embodiment, the numbers of the warp yarns 311 passed by the first wire winding portions 372 are the same, and the numbers of the weft yarns 312 passed by the first wire winding portions 372 are the same; the numbers of the warp yarns 311 passed by the second wire winding portions 374 are the same, and the numbers of the weft yarns 312 passed by the second wire winding portions 374 are the same; the numbers of the warp yarns 311 passed by the third wire winding portions 376 are the same, and the numbers of the weft yarns 312 passed by the third wire winding portions 376 are the same; the numbers of the warp yarns 311 passed by the fourth wire winding portions 378 are the same, and the numbers of the weft yarns 312 passed by the fourth wire winding portions 378 are the same. Thereby, the at least one wire 32 is fixed on the at least one wire disposing area 316 by the at least one first fixing sewing thread 33 and the at least one second fixing sewing thread 37 in a quite regular winding manner, and the at least one first fixing sewing thread 33 and the at least one second fixing sewing thread 37 extend in opposite directions and intersect with each other.

Figure 12:
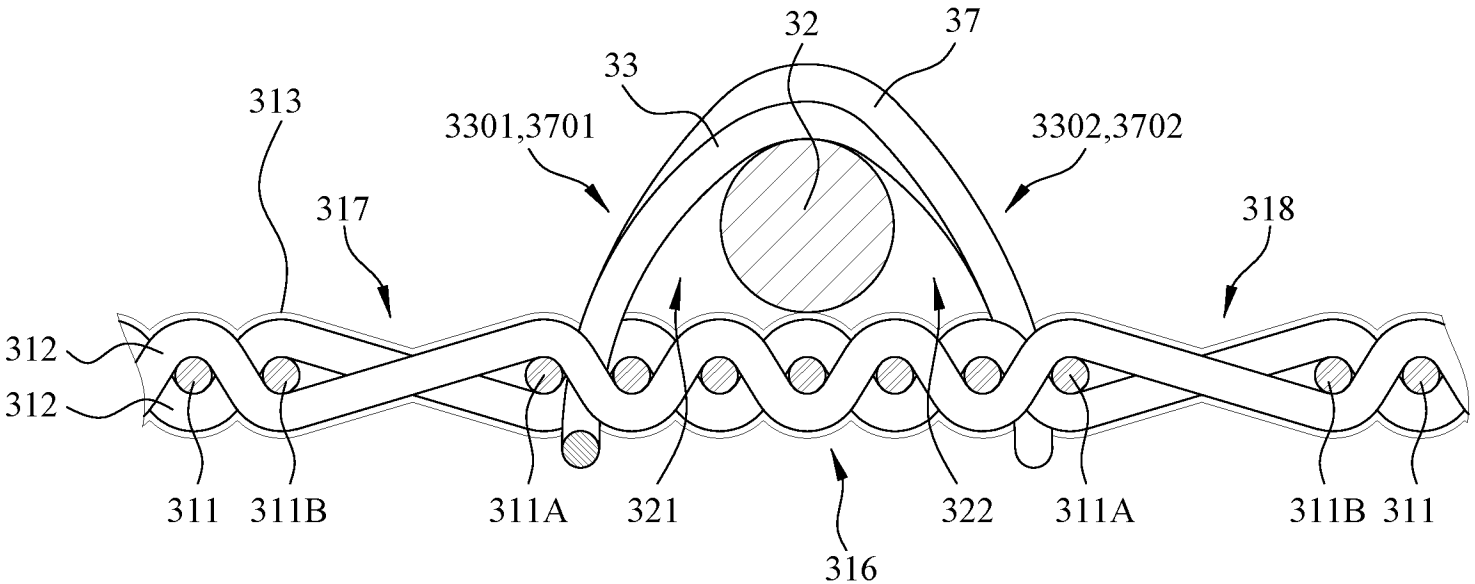
FIG. 12 is a cross-sectional view along line E-E of FIG. 10.

As shown in FIG. 12, the wire 32 is harder than the main body 31, the elasticity and toughness of the wire 32 are worse than those of the main body 31, and the at least one wire 32 is fixed on the wire disposing area 316 by the at least one first fixing sewing thread 33 and the at least one second fixing sewing thread 37 in a quite regular winding manner. Therefore, affected by the shrinkage, a first elastic adjustment area 317 is formed between two warp yarns 311 (i.e., a first warp yarn 311A and a second warp yarn 311B) closest to outside of a first side 3301 of the at least one first fixing sewing thread 33 and outside of a first side 3701 of the at least one second fixing sewing thread 37, and a second elastic adjustment area 318 is formed between two warp yarns 311 (i.e., a first warp yarn 311A and a second warp yarn 311B) closest to outside of a second side 3302 of the at least one first fixing sewing thread 33 and outside of a second side 3702 of the at least one second fixing sewing thread 37. The widths of the first elastic adjustment area 317 and the second elastic adjustment area 318 are equal to each other, and the distances between the remaining warp yarns 311 are less than the width of each of the first elastic adjustment area 317 and the second elastic adjustment area 318. The effects of the first elastic adjustment area 317 and the second elastic adjustment area 318 of the fourth embodiment are exactly the same as the fourth embodiment.

Figure 10:
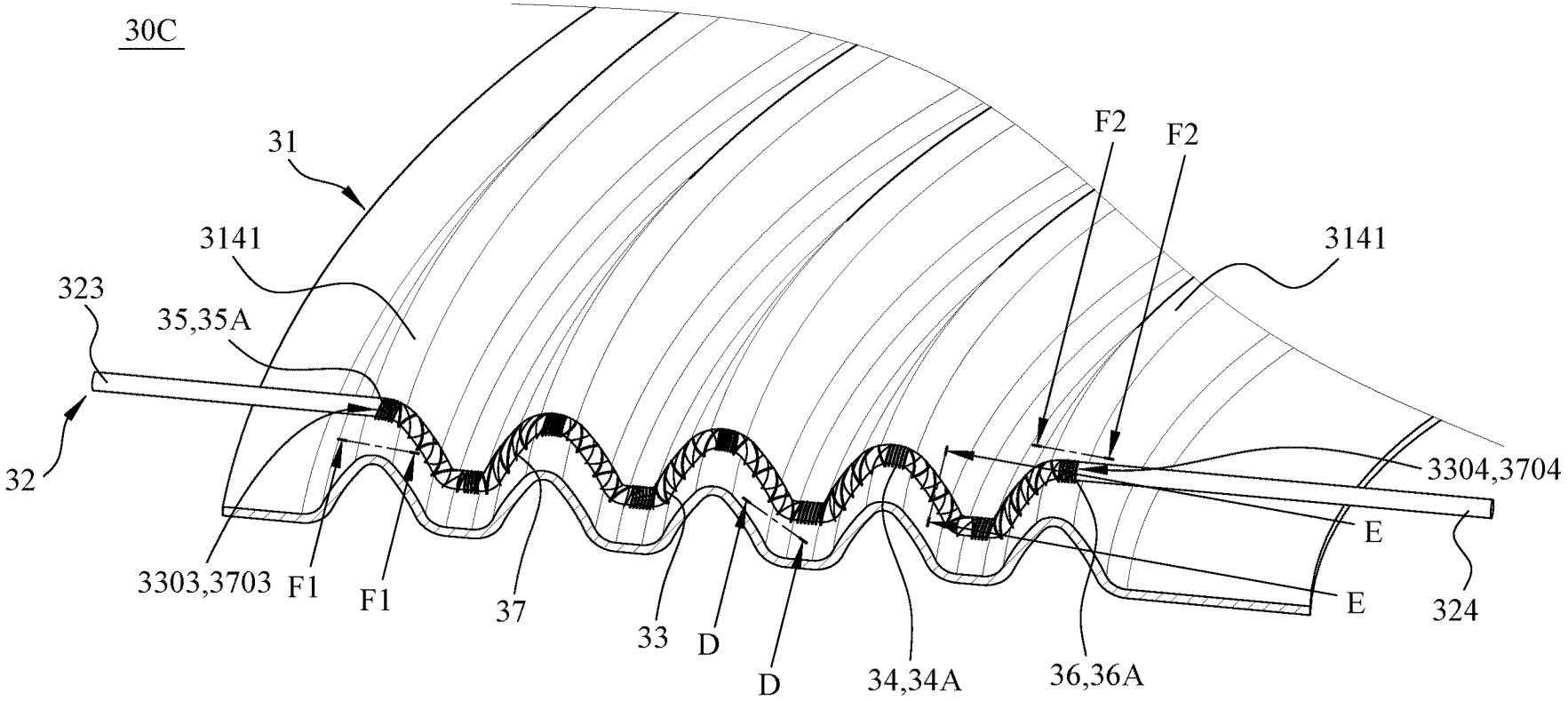
FIG. 10 is a schematic view of the damper of the fourth embodiment of the present invention.

As shown in FIGS. 10 and 11, in the fourth embodiment, one end of the at least one second fixing sewing thread 37 close to the outer edge of the main body 31 is defined as a first end 3703, and one end of the at least one second fixing sewing thread 37 close to the inner edge of the main body 31 is defined as a second end 3704. The at least one second fixing sewing thread 37 further includes at least one second intermediate sewing structure 34A. The at least one second intermediate sewing structure 34A is disposed between the first end 3703 and the second end 3704 of the at least one second fixing sewing thread 37, extends from the second side 322 of the at least one wire 32 through upside of the at least one wire 32 to the first side 321 of the at least one wire 32, and is fixed at a part of the plurality of warp yarns 311 and a part of the plurality of weft yarns 312 around the at least one wire disposing area 316. The at least one second intermediate sewing structure 34A is disposed around outside of the at least one first intermediate sewing structure 34. In other words, the at least one first intermediate sewing structure 34 and the at least one second intermediate sewing structure 34A can be distributed at any one of the wave crests 3141, the wave troughs 3142, the inner sidewalls 3143 and the outer sidewalls 3144 of the wave structures 314. Therefore, the at least one first intermediate sewing structure 34 and the at least one second intermediate sewing structure 34A can further improve the effect of fixing the at least one wire 32 on the at least one wire disposing area 316.

Preferably, as shown in FIG. 10, the at least one first fixing sewing thread 33 includes a plurality of first intermediate sewing structures 34, and the at least one second fixing sewing thread 37 includes a plurality of second intermediate sewing structures 34A. The first intermediate sewing structures 34 are arranged at intervals between the first end 3303 and the second end 3304 of the at least one first fixing sewing thread 33, and the second intermediate sewing structures 34A are arranged at intervals between the first end 3703 and the second end 3704 of the at least one second fixing sewing thread 37. Thereby, when the numbers of the first intermediate sewing structures 34 and the second intermediate sewing structures 34A are larger, the effect of fixing the at least one wire 32 on the at least one wire disposing area 316 is better.

Preferably, each second intermediate sewing structure 34A includes a plurality of winding sewing threads 341A arranged sequentially along the extending direction of the at least one wire 32 and being close to each other. The radial width of each second intermediate sewing structure 34A is fixed, while the number of lines of the winding sewing threads 341A will affect the axial length of each second intermediate sewing structure 34A. Wherein, the axial length and the radial width of each second intermediate sewing structure 34A are equal to each other, which enables each second intermediate sewing structure 34A to fix the at least one wire 32 on the at least one wire disposing area 316 in a stronger manner.

Figure 13:
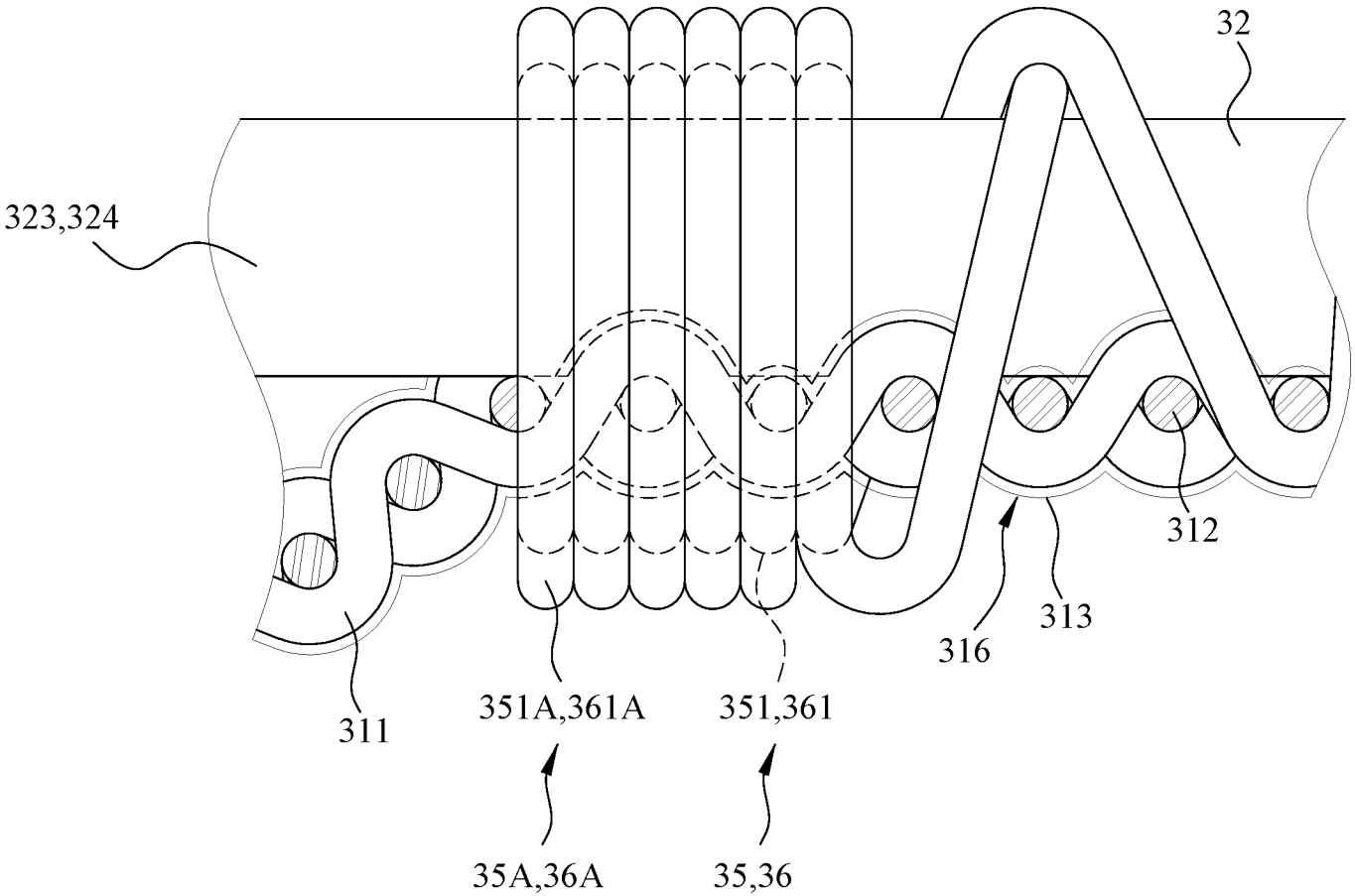
FIG. 13 is a cross-sectional view along line F1-F1 and line F2-F2 of FIG. 10.

As shown in FIGS. 10 and 13, in the fourth embodiment, the first end 3703 of the at least one second fixing sewing thread 37 further forms a first end sewing structure 35A. The first end sewing structure 35A of the at least one second fixing sewing thread 37 extends from the second side 322 of the at least one wire 32 through upside of the at least one wire 32 to the first side 321 of the at least one wire 32, and is fixed at a part of the plurality of warp yarns 311 and a part of the plurality of weft yarns 312 around the at least one wire disposing area 316. The first end sewing structure 35A of the at least one second fixing sewing thread 37 is disposed around outside of the first end sewing structure 35 of the at least one first fixing sewing thread 33. The second end 3704 of the at least one second fixing sewing thread 37 further forms a second end sewing structure 36A. The second end sewing structure 36A of the at least one second fixing sewing thread 37 extends from the second side 322 of the at least one wire 32 through upside of the at least one wire 32 to the first side 321 of the at least one wire 32, and is fixed at a part of the plurality of warp yarns 311 and a part of the plurality of weft yarns 312 around the at least one wire disposing area 316. The second end sewing structure 36A of the at least one second fixing sewing thread 37 is disposed around outside of the second end sewing structure 36A of the at least one first fixing sewing thread 33. Thereby, the first end sewing structure 35 of the at least one first fixing sewing thread 33 and the first end sewing structure 35A of the at least one second fixing sewing thread 37 can be fixed at the at least one wire disposing area 316, and the second end sewing structure 36 of the at least one first fixing sewing thread 33 and the second end sewing structure 36A of the at least one second fixing sewing thread 37 can be fixed at the at least one wire disposing area 316. It prevents the first end 3303 and the second end 3304 of the at least one first fixing sewing thread 33 from lifting upward relative to the main body 31, and prevents the first end 3703 and the second end 3704 of the at least one second fixing sewing thread 37 from lifting upward relative to the main body 31. Also, it prevents the at least one first fixing sewing thread 33 from being pulled off the main body 31 at the first end 3303 or the second end 3304 of the at least one first fixing sewing thread 33, and prevents the at least one second fixing sewing thread 37 from being pulled off the main body 31 at the first end 3703 or the second end 3704 of the at least one second fixing sewing thread 37.

Preferably, the first end sewing structure 35A of the at least one second fixing sewing thread 37 includes a plurality of winding sewing threads 351A arranged sequentially along the extending direction of the at least one wire 32 and being close to each other. The second end sewing structure 36A of the at least one second fixing sewing thread 37 includes a plurality of winding sewing threads 361A arranged sequentially along the extending direction of the at least one wire 32 and being close to each other. The radial widths of the first end sewing structure 35A and the second end sewing structure 36A of the at least one second fixing sewing thread 37 are fixed, while the number of lines of the winding sewing threads 351A will affect the axial length of the first end sewing structure 35A of the at least one second fixing sewing thread 37, and the number of lines the winding sewing threads 361A will affect the axial length of the second end sewing structure 36A of the at least one second fixing sewing thread 37. Wherein, the axial length and the radial width of the first end sewing structure 35A of the at least one second fixing sewing thread 37 are equal to each other, and the axial length and the radial width of the second end sewing structure 36A of the at least one second fixing sewing thread 37 are equal to each other. In other words, the first end sewing structure 35A and the second end sewing structure 36A of the at least one second fixing sewing thread 37 are in rectangular block shapes. Thereby, the first end sewing structure 35A and the second end sewing structure 36A of the at least one second fixing sewing thread 37, which are in rectangular block shapes, can fix the at least one wire 32 on the at least one wire disposing area 316 in a stronger manner.

As shown in FIG. 10, in the fourth embodiment, the first end sewing structure 35 of the at least one first fixing sewing thread 33 and the first end sewing structure 35A of the at least one second fixing sewing thread 37 are simultaneously located at the wave crest 3141 of the wave structure 314 closest to the outer edge of the main body 31, so as to limit the first end 323 of the at least one wire 32 to extend in a direction parallel to the main body 31. Also, the second end sewing structure 36 of the at least one first fixing sewing thread 33 and the second end sewing structure 36A of the at least one second fixing sewing thread 37 are simultaneously located at the wave crest 3141 of the wave structure 314 closest to the inner edge of the main body 31, so as to limit the second end 324 of the at least one wire 32 to extend in a direction parallel to the main body 31.

Another embodiment (not shown) is different from the fourth embodiment in that the first end sewing structure 35 of the at least one first fixing sewing thread 33 and the first end sewing structure 35A of the at least one second fixing sewing thread 37 are simultaneously located at the inner sidewall 3143 of the wave structure 314 closest to the outer edge of the main body 31, so as to limit the first end 323 of the at least one wire 32 to extend in a direction tilting upward and outward relative to the main body 31. Also, the second end sewing structure 36 of the at least one first fixing sewing thread 33 and the second end sewing structure 36A of the at least one second fixing sewing thread 37 are simultaneously located at the outer sidewall 3144 of the wave structure 314 closest to the inner edge of the main body 31, so as to limit the second end 324 of the at least one wire 32 to extend in a direction tilting upward and inward relative to the main body 31.

Yet another embodiment (not shown) is different from the fourth embodiment in that the first end sewing structure 35 of the at least one first fixing sewing thread 33 and the first end sewing structure 35A of the at least one second fixing sewing thread 37 are simultaneously located at the outer sidewall 3144 of the wave structure 314 closest to the outer edge of the main body 31, so as to limit the first end 323 of the at least one wire 32 to extend in a direction tilting downward and outward relative to the main body 31. Also, the second end sewing structure 36 of the at least one first fixing sewing thread 33 and the second end sewing structure 36A of the at least one second fixing sewing thread 37 are simultaneously located at the inner sidewall 3143 of the wave structure 314 closest to the inner edge of the main body 31, so as to limit the second end 324 of the at least one wire 32 to extend in a direction tilting downward and inward relative to the main body 31.

Figure 14:
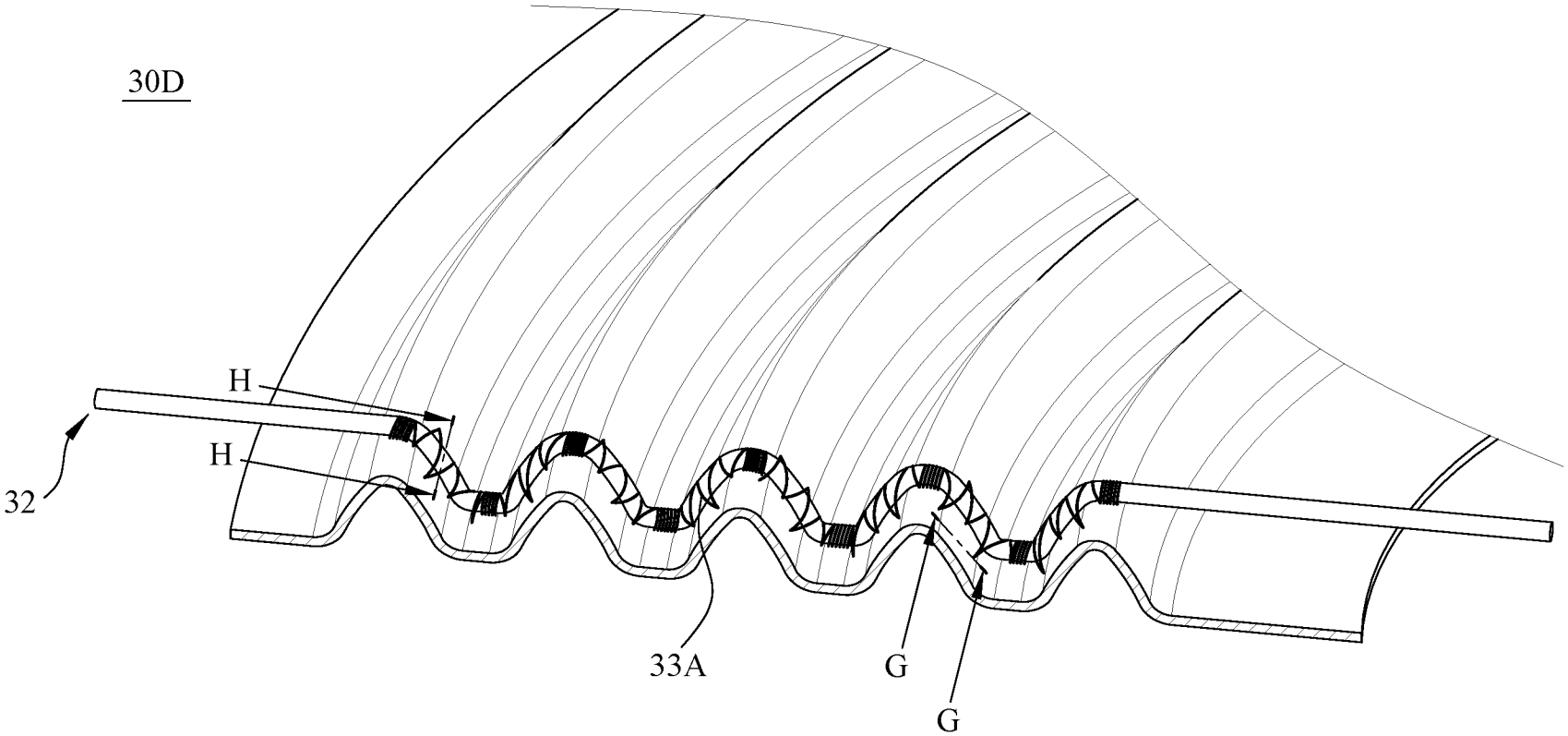
FIG. 14 is a schematic view of the damper of the fifth embodiment of the present invention.
Figure 15:
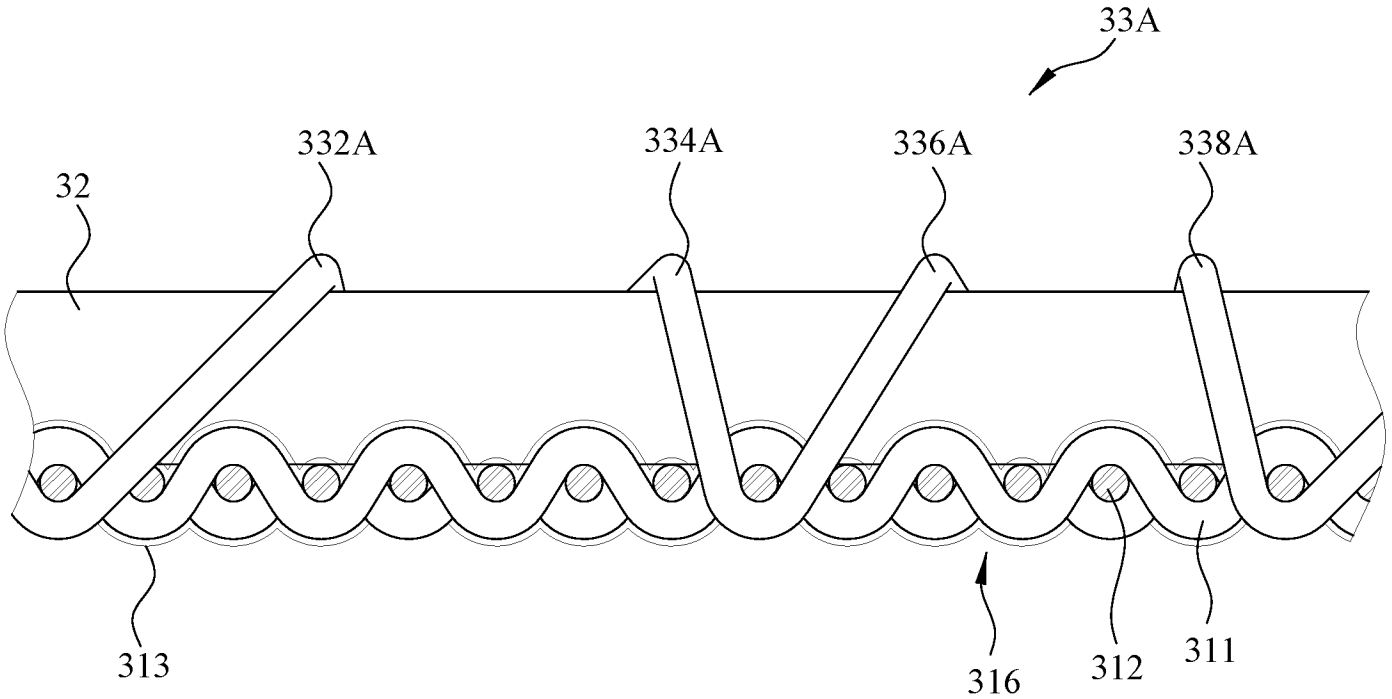
FIG. 15 is a cross-sectional view along line G-G of FIG. 14.
Figure 16:
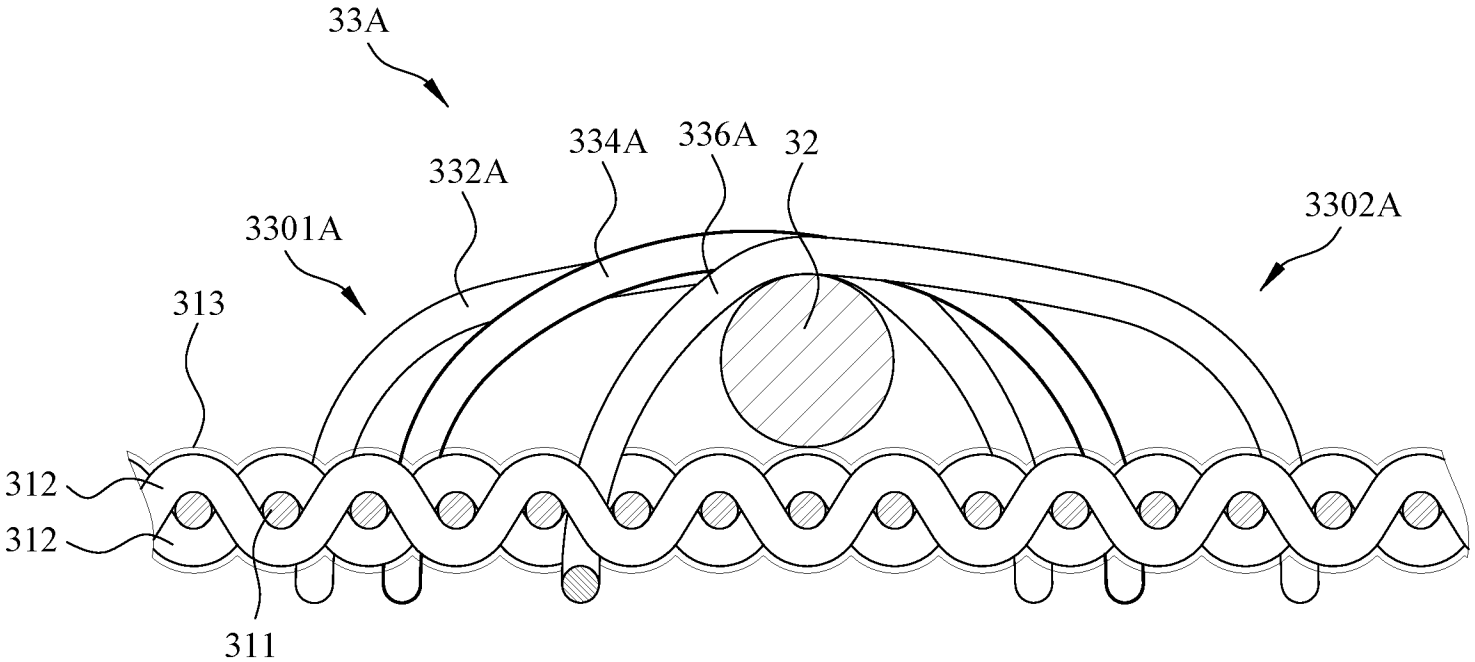
FIG. 16 is a cross-sectional view along line H-H of FIG. 14.

Referring to FIGS. 14 to 16, a damper 30D of the fifth embodiment is different from the damper 30 of the first embodiment in that the winding rules of respective at least one first fixing sewing threads 33A are different. More specifically, the numbers of the warp yarns 311 passed by the first wire winding portions 332A are partially the same and partially different or are all different, and the numbers of the weft yarns 312 passed by the first wire winding portions 332A are partially the same and partially different or are all different; the numbers of the warp yarns 311 passed by the second wire winding portions 334A are partially the same and partially different or are all different, and the numbers of the weft yarns 312 passed by the second wire winding portions 334A are partially the same and partially different or are all different; the numbers of the warp yarns 311 passed by the third wire winding portions 336A are partially the same and partially different or are all different, and the numbers of the weft yarns 312 passed by the third wire winding portions 336A are partially the same and partially different or are all different; the numbers of the warp yarns 311 passed by the fourth wire winding portions 338A are partially the same and partially different or are all different, and the numbers of the weft yarns 312 passed by the fourth wire winding portions 338A are partially the same and partially different or are all different. As a result, the at least one wire 32 is fixed on the at least one wire disposing area 316 by the at least one first fixing sewing thread 33A in an irregular winding manner, which prevents the warp yarns 311 close to outside of a first side 3301A of the at least one first fixing sewing thread 33A from shifting outward, and prevents the warp yarns 311 close to outside of a second side 3302A of the at least one first fixing sewing thread 33A from shifting outward, thereby ensuring that the distances between the warp yarns 311 at both sides of the at least one wire disposing area 316 are the same. Comparing to the foregoing embodiments, the overall structure of the main body 31 of the fifth embodiment is more sturdy and compact, less deformable, stronger in structure and more durable, and the output sound quality of the loudspeaker is better.

Figure 17:
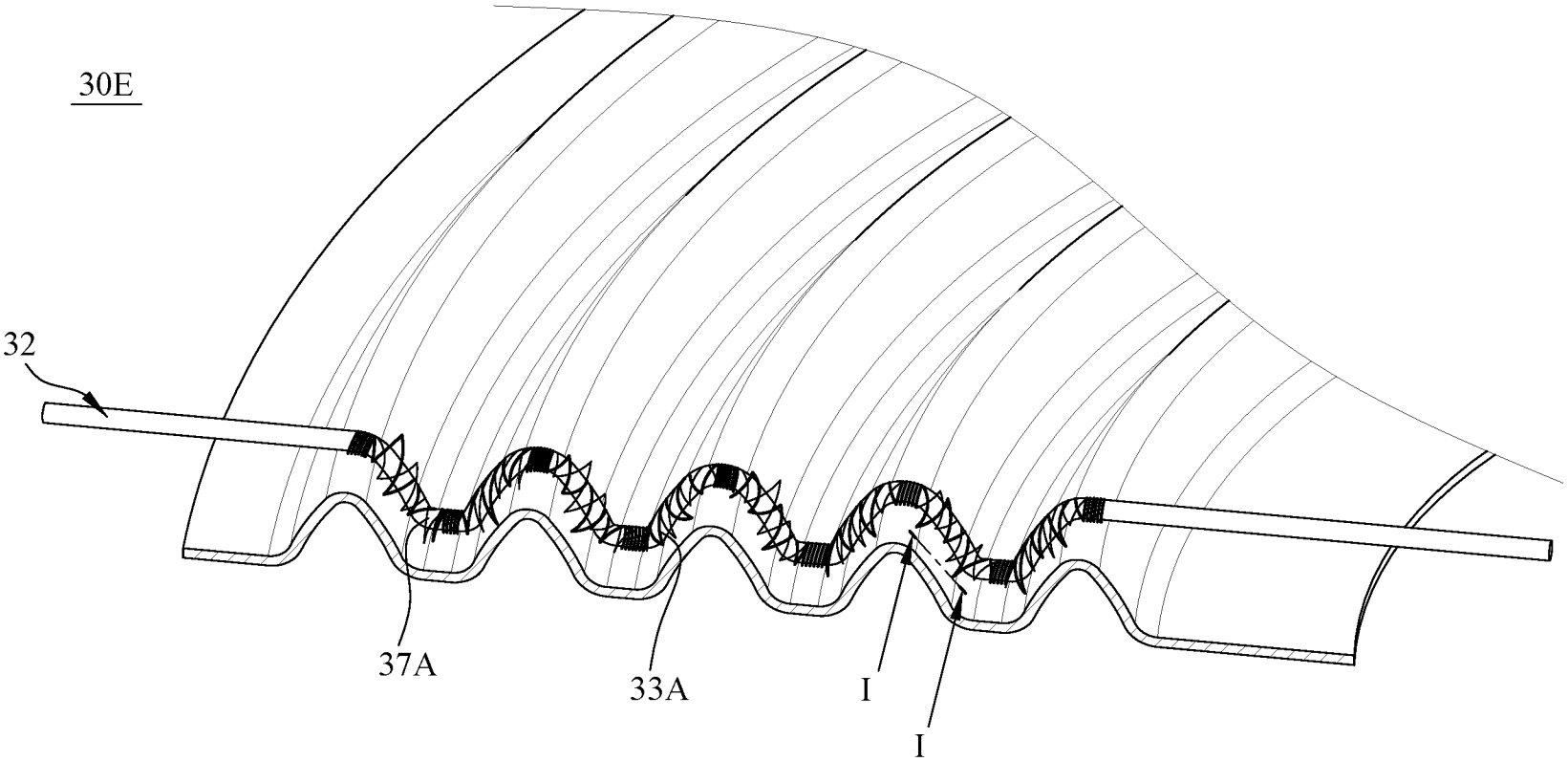
FIG. 17 is a schematic view of the damper of the sixth embodiment of the present invention.
Figure 18:
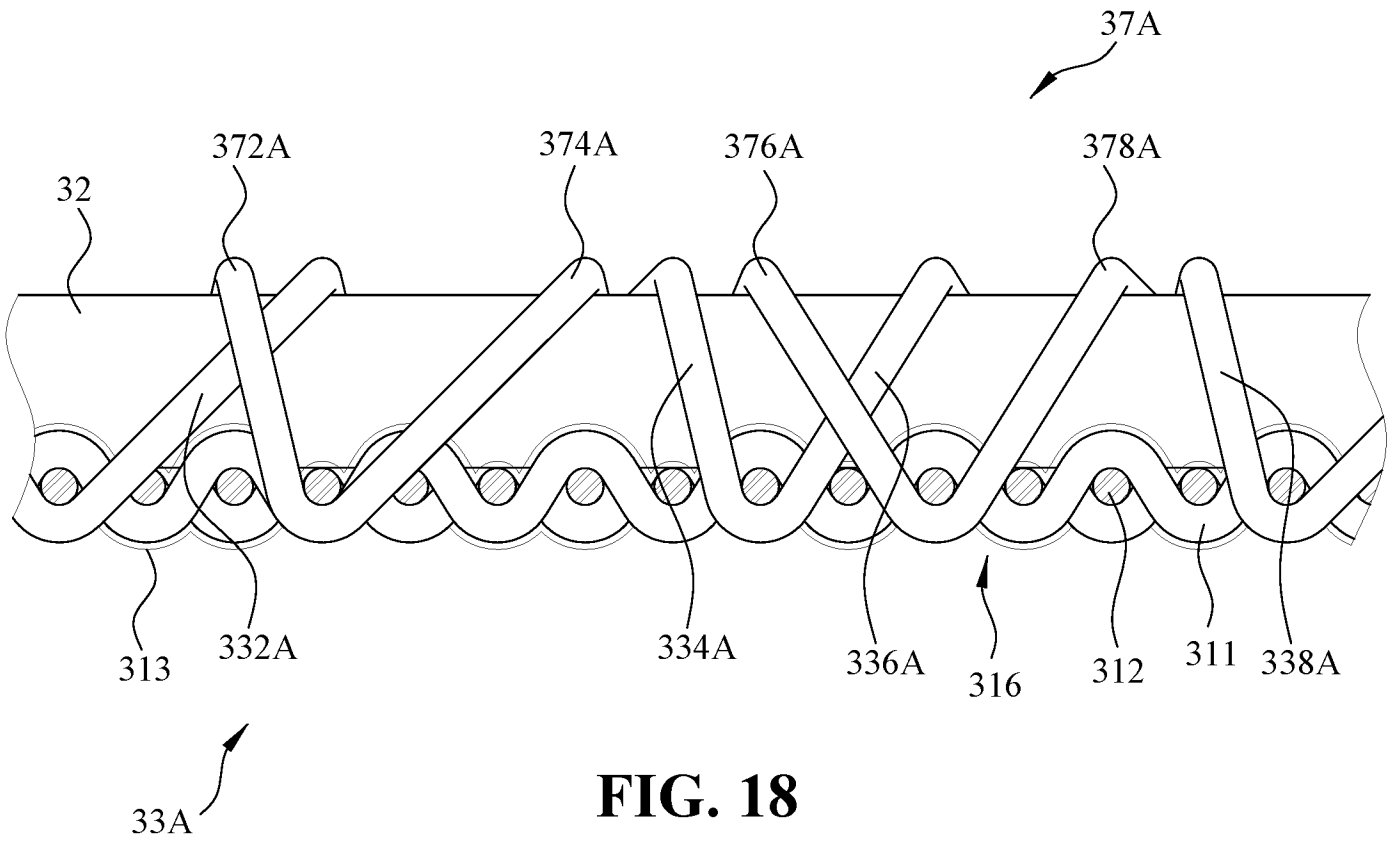
FIG. 18 is a cross-sectional view along line I-I of FIG. 17.

Referring to FIGS. 17 to 18, a damper 30E of the sixth embodiment is different from the damper 30D of the fifth embodiment in that the damper 30E further includes at least one second fixing sewing thread 37A. In more detail, the numbers of the warp yarns 311 passed by the first wire winding portions 372A are partially the same and partially different or are all different, and the numbers of the weft yarns 312 passed by the first wire winding portions 372A are partially the same and partially different or are all different; the numbers of the warp yarns 311 passed by the second wire winding portions 374A are partially the same and partially different or are all different, and the numbers of the weft yarns 312 passed by the second wire winding portions 374A are partially the same and partially different or are all different; the numbers of the warp yarns 311 passed by the third wire winding portions 376A are partially the same and partially different or are all different, and the numbers of the weft yarns 312 passed by the third wire winding portions 376A are partially the same and partially different or are all different; the numbers of the warp yarns 311 passed by the fourth wire winding portions 378A are partially the same and partially different or are all different, and the numbers of the weft yarns 312 passed by the fourth wire winding portions 378A are partially the same and partially different or are all different. Thereby, the at least one wire 32 is fixed on the at least one wire disposing area 316 by the at least one first fixing sewing thread 33A and the at least one second fixing sewing thread 37A in an irregular winding manner, and the at least one first fixing sewing thread 33A and the at least one second fixing sewing thread 37A extend in opposite directions and intersect with each other. It prevents the warp yarns 311 close to outside of the first side of the at least one first fixing sewing thread 33A and outside of the first side of the at least one second fixing sewing thread 37A from shifting outward, and prevents the warp yarns 311 close to outside of the second side of the at least one first fixing sewing thread 33A and outside of the second side of the at least one second fixing sewing thread 37A from shifting outward, thereby ensuring that the distances between the warp yarns 311 at both sides of the at least one wire disposing area 316 are the same. Therefore, the sixth embodiment can achieve the same effect as the fifth embodiment.

The mentioned above are only preferred embodiments for explaining the present invention but intend to limit the present invention in any forms, so that any modifications or verification relating to the present invention made in the same spirit of the invention should still be included in the scope of the invention as intended to be claimed.

What is claimed is:

1. A loudspeaker, comprising:

a loudspeaker body;

a voice coil movably disposed in the loudspeaker body; and a damper, including:

a main body, which is formed by interweaving a plurality of warp yarns and a plurality of weft yarns, a solid resin layer is formed on a surface of the main body, the main body includes a plurality of wave structures, a center hole and at least one wire disposing area, the wave structures are sequentially arranged from an outer edge of the main body to the center hole, the center hole is sleeved at the voice coil, and the at least one wire disposing area extends radially from the outer edge of the main body through the wave structures to the center hole;

at least one wire, which is disposed on the at least one wire disposing area, and one end of the at least one wire is connected to the voice coil; and at least one first fixing sewing thread, which includes a plurality of first sewing parts, the first sewing parts are arranged at intervals along an extending direction of the at least one wire and fix the at least one wire on the at least one wire disposing area, wherein each of the first sewing parts includes a first wire winding portion, a first yarn winding portion, a second wire winding portion, a second yarn winding portion, a third wire winding portion, a third yarn winding portion and a fourth wire winding portion; the first wire winding portion of each of the first sewing parts extends from a first side of the at least one wire through upside of the at least one wire, at least one of the warp yarns and at least one of the weft yarns to a second side of the at least one wire; the first yarn winding portion of each of the first sewing parts connects the first wire winding portion of each of the first sewing parts and the second wire winding portion of each of the first sewing parts, and passes under one of the weft yarns; the second wire winding portion of each of the first sewing parts extends from the second side of the at least one wire through upside of the at least one wire, at least one of the warp yarns and at least one of the weft yarns to the first side of the at least one wire; the second yarn winding portion of each of the first sewing parts connects the second wire winding portion of each of the first sewing parts and the third wire winding portion of each of the first sewing parts, and passes under one of the weft yarns; the third wire winding portion of each of the first sewing parts extends from the first side of the at least one wire through upside of the at least one wire, at least one of the warp yarns and at least one of the weft yarns to the second side of the at least one wire; the third yarn winding portion of each of the first sewing parts connects the third wire winding portion of each of the first sewing parts and the fourth wire winding portion of each of the first sewing parts, and passes under one of the weft yarns; and the fourth wire winding portion of each of the first sewing parts extends from the second side of the at least one wire through upside of the at least one wire, at least one of the warp yarns and at least one of the weft yarns to the first side of the at least one wire.

2. The loudspeaker according to claim 1, wherein numbers of the warp yarns passed by the first wire winding portions of the first sewing parts are the same, and numbers of the weft yarns passed by the first wire winding portions of the first sewing parts are the same; numbers of the warp yarns passed by the second wire winding portions of the first sewing parts are the same, and numbers of the weft yarns passed by the second wire winding portions of the first sewing parts are the same; numbers of the warp yarns passed by the third wire winding portions of the first sewing parts are the same, and numbers of the weft yarns passed by the third wire winding portions of the first sewing parts are the same; and numbers of the warp yarns passed by the fourth wire winding portions of the first sewing parts are the same, and numbers of the weft yarns passed by the fourth wire winding portions of the first sewing parts are the same; and wherein a first elastic adjustment area is formed between two of the warp yarns closest to outside of a first side of the at least one first fixing sewing thread, a second elastic adjustment area is formed between two of the warp yarns closest to outside of a second side of the at least one first fixing sewing thread, widths of the first elastic adjustment area and the second elastic adjustment area are equal to each other, and distances between the remaining warp yarns are less than the width of each of the first elastic adjustment area and the second elastic adjustment area.

3. The loudspeaker according to claim 1, wherein the at least one wire is fixed on the at least one wire disposing area by the at least one first fixing sewing thread in an irregular winding manner.

4. The loudspeaker according to claim 1, wherein one end of the at least one first fixing sewing thread close to the outer edge of the main body is defined as a first end, and one end of the at least one first fixing sewing thread close to an inner edge of the main body is defined as a second end; the at least one first fixing sewing thread further includes at least one first intermediate sewing structure; and the at least one first intermediate sewing structure is disposed between the first end and the second end of the at least one first fixing sewing thread, extends from the first side of the at least one wire through upside of the at least one wire to the second side of the at least one wire, and is fixed at a part of the plurality of warp yarns and a part of the plurality of weft yarns around the at least one wire disposing area.

5. The loudspeaker according to claim 1, wherein one end of the at least one first fixing sewing thread close to the outer edge of the main body is defined as a first end; the first end of the at least one first fixing sewing thread further forms a first end sewing structure; and the first end sewing structure of the at least one first fixing sewing thread extends from the first side of the at least one wire through upside of the at least one wire to the second side of the at least one wire, and is fixed at a part of the plurality of warp yarns and a part of the plurality of weft yarns around the at least one wire disposing area.

6. The loudspeaker according to claim 1, wherein one end of the at least one first fixing sewing thread close to an inner edge of the main body is defined as a second end; the second end of the at least one first fixing sewing thread further forms a second end sewing structure; and the second end sewing structure of the at least one first fixing sewing thread extends from the first side of the at least one wire through upside of the at least one wire to the second side of the at least one wire, and is fixed at a part of the plurality of warp yarns and a part of the plurality of weft yarns around the at least one wire disposing area.

7. The loudspeaker according to claim 1, wherein the damper further comprises at least one second fixing sewing thread including a plurality of second sewing parts, the second sewing parts are arranged at intervals along the extending direction of the at least one wire and fix the at least one wire on the at least one wire disposing area, wherein each of the second sewing parts includes a first wire winding portion, a first yarn winding portion, a second wire winding portion, a second yarn winding portion, a third wire winding portion, a third yarn winding portion and a fourth wire winding portion; the first wire winding portion of each of the second sewing parts extends from the second side of the at least one wire through upside of the at least one wire, the first wire winding portion of each of the first sewing parts, at least one of the warp yarns and at least one of the weft yarns to the first side of the at least one wire; the first yarn winding portion of each of the second sewing parts connects the first wire winding portion of each of the second sewing parts and the second wire winding portion of each of the second sewing parts, and passes under one of the weft yarns; the second wire winding portion of each of the second sewing parts extends from the first side of the at least one wire through upside of the at least one wire, the second wire winding portion of each of the first sewing parts, at least one of the warp yarns and at least one of the weft yarns to the second side of the at least one wire; the second yarn winding portion of each of the second sewing parts connects the second wire winding portion of each of the second sewing parts and the third wire winding portion of each of the second sewing parts, and passes under one of the weft yarns; the third wire winding portion of each of the second sewing parts extends from the second side of the at least one wire through upside of the at least one wire, the third wire winding portion of each of the first sewing parts, at least one of the warp yarns and at least one of the weft yarns to the first side of the at least one wire; the third yarn winding portion of each of the second sewing parts connects the third wire winding portion of each of the second sewing parts and the fourth wire winding portion of each of the second sewing parts, and passes under one of the weft yarns; and the fourth wire winding portion of each of the second sewing parts extends from the first side of the at least one wire through upside of the at least one wire, the fourth wire winding portion of each of the first sewing parts, at least one of the warp yarns and at least one of the weft yarns to the second side of the at least one wire.

8. The loudspeaker according to claim 7, wherein numbers of the warp yarns passed by the first wire winding portions of the first sewing parts are the same, and numbers of the weft yarns passed by the first wire winding portions of the first sewing parts are the same; numbers of the warp yarns passed by the second wire winding portions of the first sewing parts are the same, and numbers of the weft yarns passed by the second wire winding portions of the first sewing parts are the same; numbers of the warp yarns passed by the third wire winding portions of the first sewing parts are the same, and numbers of the weft yarns passed by the third wire winding portions of the first sewing parts are the same; and numbers of the warp yarns passed by the fourth wire winding portions of the first sewing parts are the same, and numbers of the weft yarns passed by the fourth wire winding portions of the first sewing parts are the same; wherein numbers of the warp yarns passed by the first wire winding portions of the second sewing parts are the same, and numbers of the weft yarns passed by the first wire winding portions of the second sewing parts are the same; numbers of the warp yarns passed by the second wire winding portions of the second sewing parts are the same, and numbers of the weft yarns passed by the second wire winding portions of the second sewing parts are the same; numbers of the warp yarns passed by the third wire winding portions of the second sewing parts are the same, and numbers of the weft yarns passed by the third wire winding portions of the second sewing parts are the same; and numbers of the warp yarns passed by the fourth wire winding portions of the second sewing parts are the same, and numbers of the weft yarns passed by the fourth wire winding portions of the second sewing parts are the same; and wherein a first elastic adjustment area is formed between two of the warp yarns closest to outside of a first side of the at least one first fixing sewing thread and outside of a first side of the at least one second fixing sewing thread; a second elastic adjustment area is formed between two of the warp yarns closest to outside of a second side of the at least one first fixing sewing thread and outside of a second side of the at least one second fixing sewing thread; widths of the first elastic adjustment area and the second elastic adjustment area are equal to each other, and distances between the remaining warp yarns are less than the width of each of the first elastic adjustment area and the second elastic adjustment area.

9. The loudspeaker according to claim 7, wherein the at least one wire is fixed on the at least one wire disposing area by the at least one first fixing sewing thread and the at least one second fixing sewing thread in an irregular winding manner.

10. The loudspeaker according to claim 7, wherein one end of the at least one first fixing sewing thread close to the outer edge of the main body is defined as a first end of the at least one first fixing sewing thread, and one end of the at least one first fixing sewing thread close to an inner edge of the main body is defined as a second end of the at least one first fixing sewing thread; the at least one first fixing sewing thread further includes at least one first intermediate sewing structure; and the at least one first intermediate sewing structure is disposed between the first end and the second end of the at least one first fixing sewing thread, extends from the first side of the at least one wire through upside of the at least one wire to the second side of the at least one wire, and is fixed at a part of the plurality of warp yarns and a part of the plurality of weft yarns around the at least one wire disposing area; and wherein one end of the at least one second fixing sewing thread close to the outer edge of the main body is defined as a first end of the at least one second fixing sewing thread, and one end of the at least one second fixing sewing thread close to the inner edge of the main body is defined as a second end of the at least one second fixing sewing thread; the at least one second fixing sewing thread further includes at least one second intermediate sewing structure; the at least one second intermediate sewing structure is disposed between the first end and the second end of the at least one second fixing sewing thread, extends from the second side of the at least one wire through upside of the at least one wire and the at least one first intermediate sewing structure to the first side of the at least one wire, and is fixed at a part of the plurality of warp yarns and a part of the plurality of weft yarns around the at least one wire disposing area; and the at least one second intermediate sewing structure is disposed around outside of the at least one first intermediate sewing structure.

11. The loudspeaker according to claim 7, wherein one end of the at least one first fixing sewing thread close to the outer edge of the main body is defined as a first end of the at least one first fixing sewing thread, and one end of the at least one second fixing sewing thread close to the outer edge of the main body is defined as a first end of the at least one second fixing sewing thread; each of the first end of the at least one first fixing sewing thread and the first end of the at least one second fixing sewing thread further forms a first end sewing structure; the first end sewing structure of the at least one first fixing sewing thread extends from the first side of the at least one wire through upside of the at least one wire to the second side of the at least one wire, and is fixed at a part of the plurality of warp yarns and a part of the plurality of weft yarns around the at least one wire disposing area; the first end sewing structure of the at least one second fixing sewing thread extends from the second side of the at least one wire through upside of the at least one wire to the first side of the at least one wire, and is fixed at a part of the plurality of warp yarns and a part of the plurality of weft yarns around the at least one wire disposing area; and the first end sewing structure of the at least one second fixing sewing thread is disposed around outside of the first end sewing structure of the at least one first fixing sewing thread.

12. The loudspeaker according to claim 7, wherein one end of the at least one first fixing sewing thread close to an inner edge of the main body is defined as a second end of the at least one first fixing sewing thread, and one end of the at least one second fixing sewing thread close to the inner edge of the main body is defined as a second end of the at least one second fixing sewing thread; each of the second end of the at least one first fixing sewing thread and the second end of the at least one second fixing sewing thread further forms a second end sewing structure; the second end sewing structure of the at least one first fixing sewing thread extends from the first side of the at least one wire through upside of the at least one wire to the second side of the at least one wire, and is fixed at a part of the plurality of warp yarns and a part of the plurality of weft yarns around the at least one wire disposing area; the second end sewing structure of the at least one second fixing sewing thread extends from the second side of the at least one wire through upside of the at least one wire to the first side of the at least one wire, and is fixed at a part of the plurality of warp yarns and a part of the plurality of weft yarns around the at least one wire disposing area; and the second end sewing structure of the at least one second fixing sewing thread is disposed around outside of the second end sewing structure of the at least one first fixing sewing thread.

* * * * *